United States Patent [19]

Watanabe

[11] Patent Number: 4,711,553

[45] Date of Patent: Dec. 8, 1987

[54] IMAGE FORMING APPARATUS WITH A PLURALITY OF COLORS

[75] Inventor: Junji Watanabe, Yokohama, Japan

[73] Assignee: Kabushiki Kaisha Toshiba, Kawasaki, Japan

[21] Appl. No.: 893,636

[22] Filed: Aug. 6, 1986

[30] Foreign Application Priority Data

Aug. 13, 1985 [JP] Japan ..... 60-177841
Aug. 28, 1985 [JP] Japan ..... 60-189237

[51] Int. Cl.[4] ..... G03G 15/01

[52] U.S. Cl. ..... 355/4; 346/157; 355/14 R; 358/75; 358/300

[58] Field of Search ..... 355/3 R, 4, 14 R; 358/75, 296, 300, 302; 346/157

[56] References Cited

U.S. PATENT DOCUMENTS 4,045,218 8/1977 McVeigh ..... 355/4 X
4,479,242 10/1984 Kurata ..... 355/4 X
4,551,750 11/1985 Kurata ..... 358/75
4,553,160 11/1985 Yamamoto et al. ..... 358/75
4,589,035 5/1986 Yamanishi et al. ..... 355/4 X
4,630,128 12/1986 Gokita ..... 358/296
4,670,795 6/1987 Yamanishi ..... 355/4 X

*Primary Examiner*—Fred L. Braun
*Attorney, Agent, or Firm*—Cushman, Darby & Cushman

[57] ABSTRACT

According to the invention, the colors of an original image are identified by a photoelectrically converting device that is movable in, e.g., the optical path of an optical system, developing units containing different color toner agents that are selectively driven based on the identification data, and an erasure array is operated to perform color image formation corresponding to the original image. More specifically, two CCD line sensors having different color filters that are arranged adjacent to each other as the photoelectrically converting device, so that the colors of the original image can be identified through a single exposure scanning operation.

4 Claims, 44 Drawing Figures

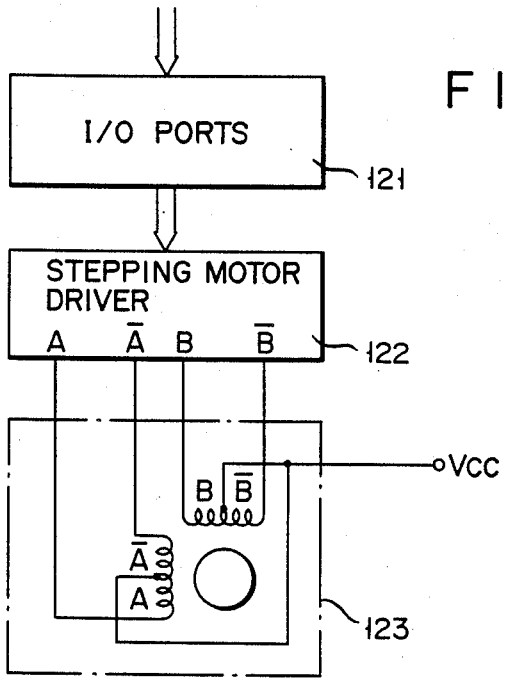
FIG. 11
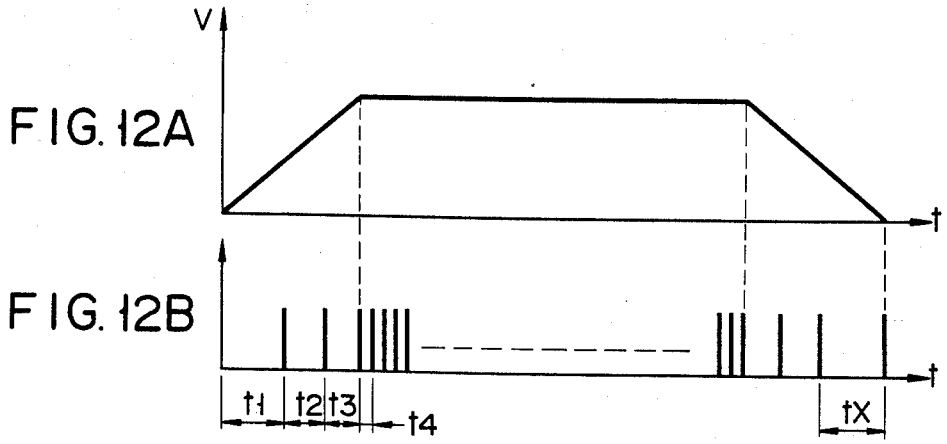
FIG. 12A
FIG. 12B

IMAGE FORMING APPARATUS WITH A PLURALITY OF COLORS

BACKGROUND OF THE INVENTION

This invention relates to an image forming apparatus with a plurality of colors and, more particularly, to an image forming apparatus suitable for an electronic copying machine that can selectively form a multicolor image within a short period of time to correspond with an original with a plurality of colors.

Many conventional copying machines can only reproduce a monocolor image even when the original has a plurality of colors. Although a multicolor image forming apparatus that can print out an image in a plurality of colors in correspondence with a multicolored original image through scanning operation has already been known, an apparatus of this type is generally expensive. In addition this type of apparatus requires a long period of time for the print-out operation.

SUMMARY OF THE INVENTION

It is, therefore, an object of the present invention to provide a new and improved image forming apparatus with a plurality of colors, which can form a multicolor image by an inexpensive image forming system using ordinary developing units.

According to the present invention, there is provided an image forming apparatus with a plurality of colors, the apparatus comprising:

an original table for placing thereon an original which possesses at least a first color and a second color;

original scanning means for optically scanning an original placed on the original table, the means having an optical system to guide the image reflecting light coming from the original into a given light path;

first and second color component detection means for transmitting electric signals corresponding to the first and second colors in response to the image reflecting light, the means being movably provided on the light path along which the image reflecting light coming from the optical system of the original scanning means passes;

original color identifying means for identifying different color areas from the electric signals for the first and second colors transmitted from the first and second color component detection means and for storing the first and second color data and first and second positional data for the first and second colors in different color areas;

image forming means for forming an image of given colors of the original, on an image forming medium by using the image reflecting light coming from the optical system of the original scanning means and by selectively driving first and second developing units which correspond to the first and second colors, respectively;

image erasing means for selectively erasing an image to be formed by the image forming means;

image forming medium return means for selectively returning the image forming medium to the image forming means after formation of an image by the image forming means;

first control means for producing a first control signal to drive the original scanning means and the first and second color component detection means prior to actual formation of an image;

second control means for reading out, at the tine of the first image forming operation, the first color data that has been stored in the original color identifying means to send them to the first developing unit of the image forming means as drive signals and the second position data which correspond to the second color data to send them to the image erasing means as erasure data and for producing a second control signal to the image forming medium return means as an instruction for a return operation; and third control means for reading out, at the time of the second image forming operation, the second color data that has been stored in the original color identifying means to send them to the second developing unit of the image forming means and the first positional data which correspond to the first color data to send them to the image erasing means as erasure data.

BRIEF DESCRIPTION OF THE DRAWINGS

These and other objects and features of the present invention can be understood through the following embodiment by reference to the accompanying drawings.

FIGS. 1 to 28A and 28B show an embodiment of an image forming apparatus according to the present invention, in which:

FIGS. 1 and 2 are a schematic perspective view and a side sectional view, respectively, showing the construction of the image forming apparatus;

FIG. 3 is a plan view of a control panel;

FIG. 4 is a perspective view showing an arrangement of drive sections;

FIG. 5 is a perspective view schematically showing a drive mechanism for an optical system;

FIG. 6 is a perspective view schematically showing a drive mechanism for indexes;

FIG. 7 is a block diagram showing a general control circuit;

FIG. 8 is a functional block diagram of a main processor group;

FIG. 9 is a functional block diagram of a first sub-processor group;

FIG. 10 is a functional block diagram of a second sub-processor group;

FIG. 11 is a block diagram of a stepping motor control circuit;

FIGS. 12A and 12B are charts for explaining a method of controlling stepping motor speed;

FIG. 13 is a perspective view of the principal part including a spot light source;

FIG. 14 is a side sectional view of the principal part including the spot light source;

FIGS. 15, 16 and 17 are plan views illustrating an operation for specifying the erasure range of the original using the spot light source;

FIGS. 20 and 21 are a perspective view and a front view, respectively, of only the principal part of the erasure array, showing the relationship between the erasure array and a photosensitive drum;

FIG. 23 is a circuit diagram illustrating the configuration of an array drive section;

FIG. 24 is a partially cut-out perspective view of a lens unit, illustrating the configuration thereof;

FIGS. 26A, 26B and 26C 27, and 28A to 28C are schematic illustrations of the operation of the apparatus; and FIGS. 29A and 28B and 30 show another embodiment of the image forming apparatus according to the present invention, in which:

FIGS. 29A and 29B are front views of a photoelectrically converting unit, and

FIG. 30 is a perspective view schematically showing a lens unit, and

FIGS. 31 to 33 are a variety illustration for modified embodiment of the present invention, in which:

FIG. 31 is a graphic illustration of the spectral wavelength characteristics of the photosensitive drum of the modified embodiment; and FIGS. 32A, 32B and 33 are schematic illustrations showing operation of the modified embodiment.

DETAILED DESCRIPTION OF THE PREFERRED EMBODIMENT

Figure 1:
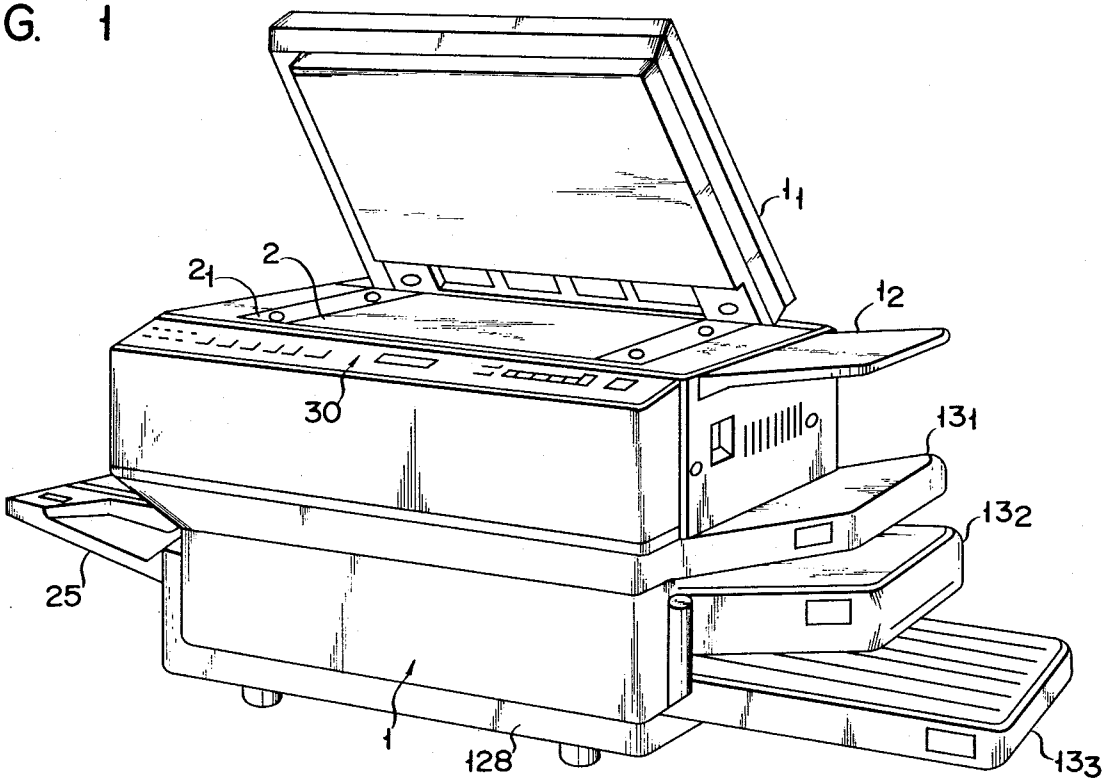
Figure 2:
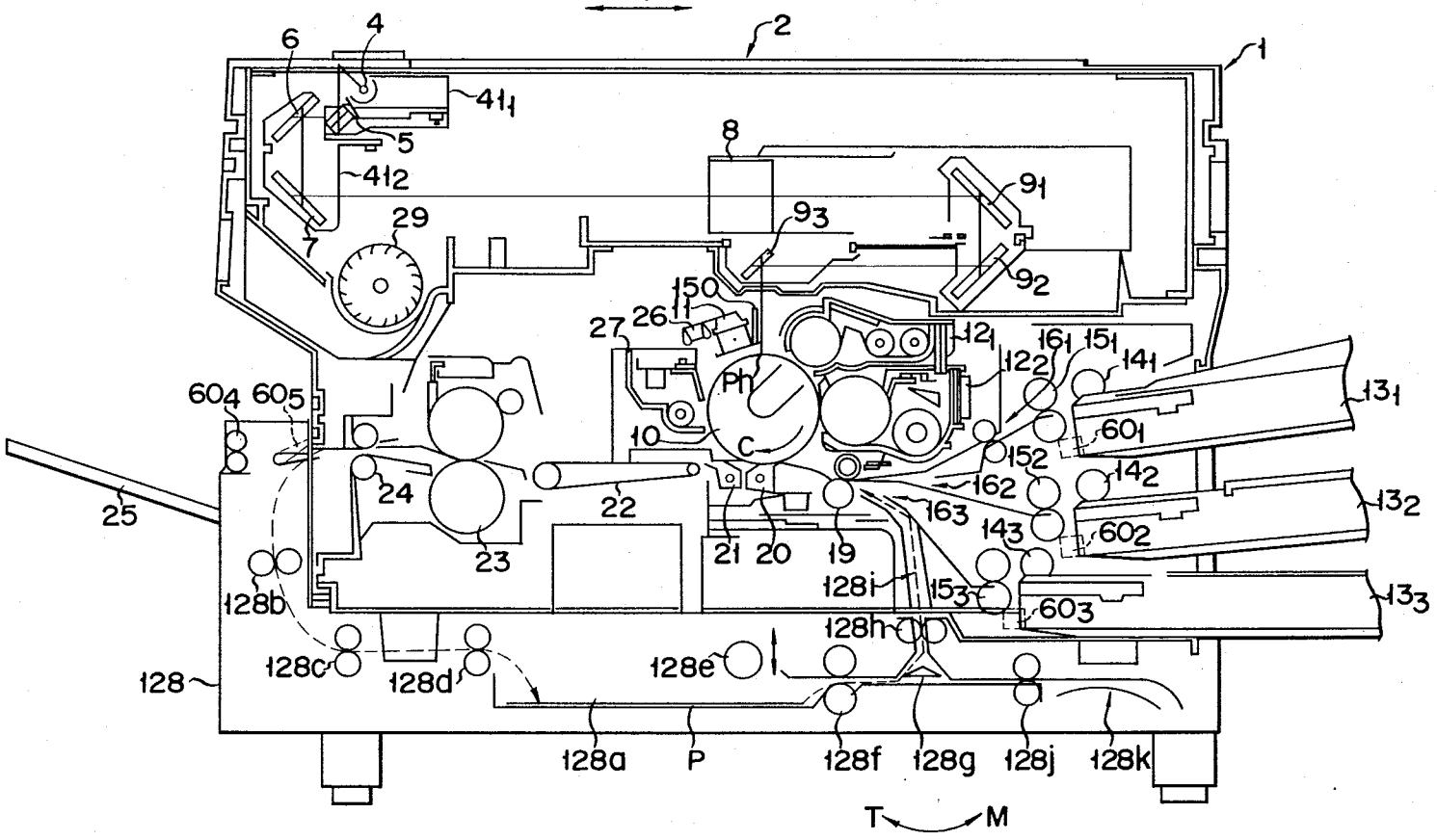

FIGS. 1 and 2 schematically show a copying machine as an image forming apparatus according to an embodiment of the present invention. Reference numeral 1 denotes a copying machine housing. An orinigal table (i.e., a transparent glass) 2 is fixed on the upper surface of the housing 1. An operable original cover 11 and a work table 12 are arranged near the table 2. A first fixed scale $2_1$ as references for setting an original is arranged at both ends of the table 2 along the longitudinal direction thereof.

The original set on the original table 2 is scanned image exposure as an optical system including an exposure lamp 4 and mirrors 5, 6 and 7 reciprocates in the direction indicated by arrow a along the under surface of the original table 2. In this case, the mirrors 6 and 7 move at a speed half that of the mirror 5 so as to maintain a fixed optical path length.

A reflected light beam from the original scanned by the optical system 3, that is, irradiated by the exposure lamp 4, is reflected by the mirrors 5, 6 and 7, transmitted through a lens block 8 for magnification or reduction, and then reflected by a mirror $9_1$, $9_2$, $9_3$ to be projected on a photosensitive drum 10. Thus, an image of the original is formed on the surface of the photosensitive drum 10.

The photosensitive drum 10 rotates in the direction indicated by arrow c so that its surface is wholly charged first by a main charger 11.

The latent image formed on drum 10 is applied with red or black toner by developing units $12_1$ and $12_2$, which are selectively operated so that the latent image can be produced as a visible image. Meanwhile, sheets (image forming media) P are selectively fed by feed rollers $14_1$, $14_2$ and $14_3$ and roller pairs $15_1$, $15_2$ and $15_3$ from upper, middle and lower cassettes $13_1$, $13_2$ and $13_3$ one by one. Each sheet is guided to aligning roller pair 19 along guide path $16_1$, $16_2$ and $16_3$ and is fed by pair 19 to the transfer section. It should be noted that cassettes $13_1$, $13_2$ and $13_3$ are detachably attached to the lower portion at the right side of housing 1. One of the cassettes must be selected at the operation panel (to be described later). Sizes of cassettes $13_1$, $13_2$ and $13_3$ are detected by cassette size detection switch $60_1$, $60_2$ and $60_3$, respectively. Switches $60_1$, $60_2$ and $60_3$ comprise a plurality of microswitches which are turned on/off upon the insertion of cassettes of different sizes.

The paper sheet P delivered to the transfer region comes into intimate contact with the surface of the photosensitive drum 10, in the space between a transfer charger 20 and the drum 10. As a result, the toner image on the photosensitive drum 10 is transferred to the paper sheet P by the agency of the charger 20. After the transfer, the paper sheet P is separated from the photosensitive drum 10 by a separation charger 21 and transported by a conveyor belt 22. Thus, the paper sheet P is delivered to a fixing roller pair 23 as a fixing unit arranged at the terminal end portion of the conveyor belt 22. As the paper sheet P passes through the fixing roller pair 23, the transferred image fixed on the sheet P. After the fixation, the paper sheet P is discharged into a tray 25 outside the housing 1 by two exit roller pairs 24, $60_4$.

After the transfer, moreover, the photosensitive drum 10 is de-electrified by a de-electrification charger 26, when the residual toner on the surface of the drum 10 is removed by a cleaner 27. Thereafter, a residual image on the photosensitive drum 10 is erased by a discharge lamp 28 to restore the initial state. In FIG. 2, numeral 29 designates a cooling fan for preventing the temperature inside the housing 1 from rising.

Two-side multicopying unit 128 is arranged at the lower portion of housing 1 to perform two-side copying or multicopying for copying different images on the same sheet surface. Unit 128 has selection gate $60_5$, discharge roller pair $60_4$, and a plurality of roller pairs 128*b*, 128*c* and 128*d* for guiding the sheet from gate $60_5$ to stacking portion 128*a*. Feedout roller 128*e* is arranged in portion 128*a* to feed out the sheets temporarily stacked in portion 128*a*. Roller 128*e* can be moved vertically in the direction of the arrow in accordance with the thickness (number) of stacked sheets. The sheets fed by roller 128*e* are separated by separation roller pair 128*f* one by one, and each sheet is guided to control gate 128*g*. Gate 128*g* is pivoted in the M direction when multicopying is performed, so that the sheet is guided to roller pair 19 through convey roller pair 128*h* along sheet guide path 128*i*. However, when time-side copying is performed, gate 128*g* is set to the position illustrated in FIG. 30, so that the sheet is guided to inverting portion 128*k* through roller pair 128*j*. When the sheet is fed to portion 128*k*, gate 128*g* is pivoted in the T direction, so that it is guided to pair 19 through pair 128*h* along path 128*i*.

Incidentally, in this example, control gate 128*g* is kept as turned to the direction indicated by arrow M so that only multiple copying is possible.

Figure 3:
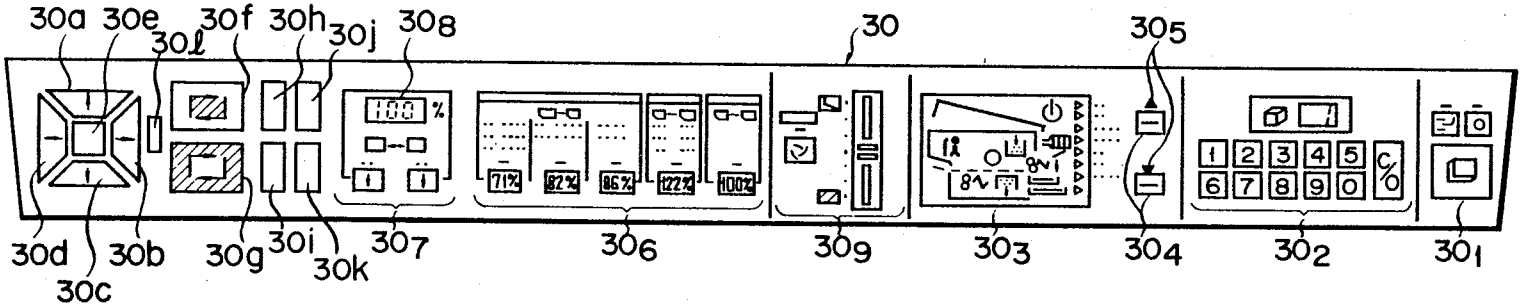

FIG. 3 shows a control panel 30 mounted on the housing 1. The control panel 30 carries thereon a copy key $30_1$ for starting the copying operation, ten-keys $30_2$ for setting the number of copies to be made and the like, a display section $30_3$ for indicating the operating conditions of the individual parts or paper jamming, cassette selection keys $30_4$ for alternatively selecting the upper or median or lower paper cassette $13_1$ or $13_2$ or $13_3$, and cassette display sections $30_5$ for indicating the selected cassette. The control panel 30 is further provided with ratio setting keys $30_6$ for setting the enlargement or reduction ratio of copy selected among several predetermined ratios, zoom keys $30_7$ for adjustably setting the enlargement or reduction ratio, a display section $30_8$ for displaying the set ratio, and a density setting section $30_9$ for setting the copy density. Additionally arranged on the control panel 30 are operation keys 30*a*, 30*b*, 30*c* and 30*d* for shifting a spot light source (mentioned later) which serves to indicate as erasure area an unnecessary portion of the original, a position designating key 30*e* for inputting the coordinate positions indicated by the spot light source, and erasure range designating keys 30*f* and 30*g* for designating the erasure ranges in the designated positions.

Reference numerals 30*h*, 30*i*, 30*j* and 30*k* designate a black and white copying specifying key, a color copying specifying key, a red specifying key to specify a developing unit $12_1$, for example, in which red toner is contained and a black specifying key to specify a developing unit $12_2$, for example, in which black toner is contained. A framed area erasure specifying key 30 will be described latter.

Figure 4:
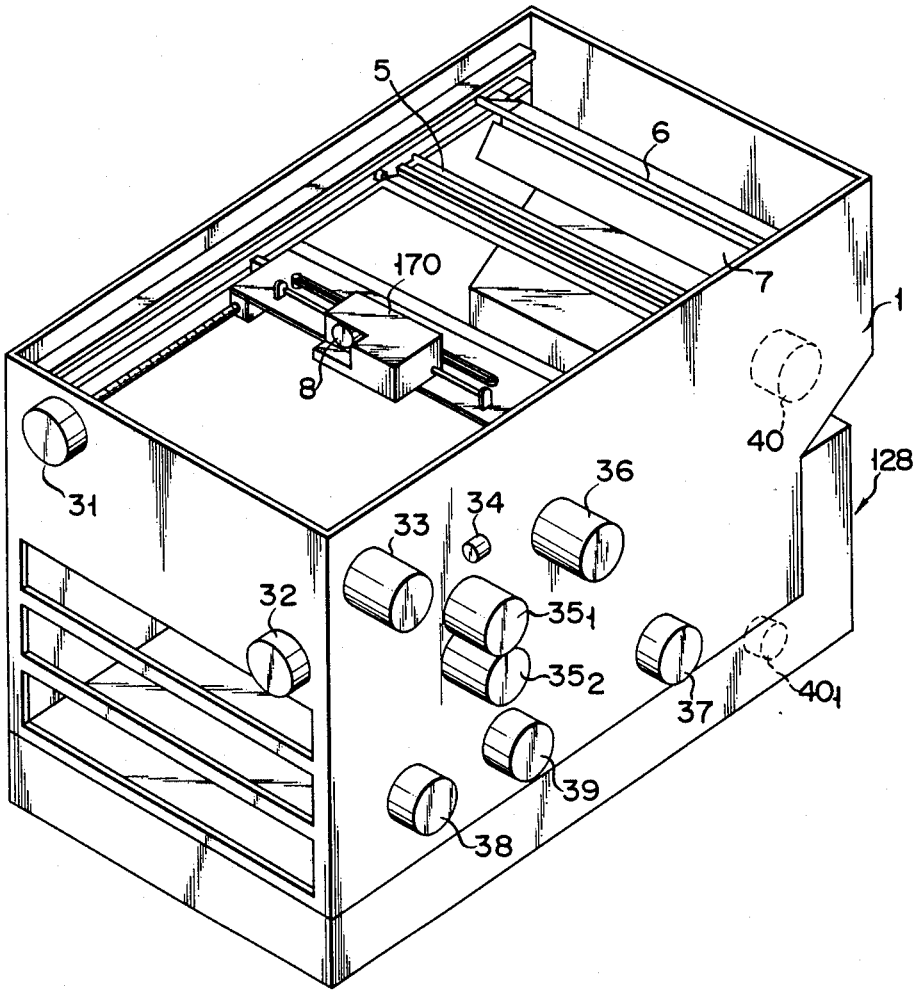

FIG. 4 shows a specific arrangement of drive sources for individual drive sections of the copying machine constructed in the aforesaid manner. The drive sources include the following motors. Numeral 31 designates a motor for lens drive. The lens drive motor 31 serves to shift the position of the lens block 8 for magnification or reduction through a lens unit 170 as described latter. Numeral 32 designates a motor for mirror drive. The mirror drive motor 32 serves to change the distance (optical path length) between the mirror 5 and the mirrors 6 and 7 for magnification or reduction. Numeral 33 designates a stepping motor for scanning. The stepping motor 33 serves to move the exposure lamp 4 and the mirrors 5, 6 and 7 for scanning the original. Numeral 34 designates a motor for shutter drive. The shutter drive motor 34 serves to move a shutter (not shown) for adjusting the width of charging of the photosensitive drum 10 by the charger 11 at the time of magnification or reduction.

Numerals $35_1$ and $35_2$ designate motors used for developing. The developing motors $35_1$ and $35_2$ serve to drive the developing roller and the like of the developing units $12_1$ and $12_2$. Numeral 36 designates a motor used to drive the drum. The drum drive motor 36 serves to drive the photosensitive drum 10. Numeral 37 designates a motor for fixation. The fixing motor 37 serves to drive the sheet conveyor belt 22, the fixing roller pair 23, and the exit roller pair $60_4$. Numeral 38 designates a motor for paper supply. The paper supply motor 38 serves to drive the paper-supply rollers $14_1$, $14_2$ and $14_3$. Numeral 39 designates a motor for feeding sheets. The sheet feed motor 39 serves to drive the aligning roller pair 19. Numeral 40 designates a motor for fan drive. The fan drive motor 40 serves to drive the cooling fan 29. Numeral $40_1$, a motor for driving roller pairs 128*a* to 128*d*, etc. and feed roller 128*e*.

Figure 5:
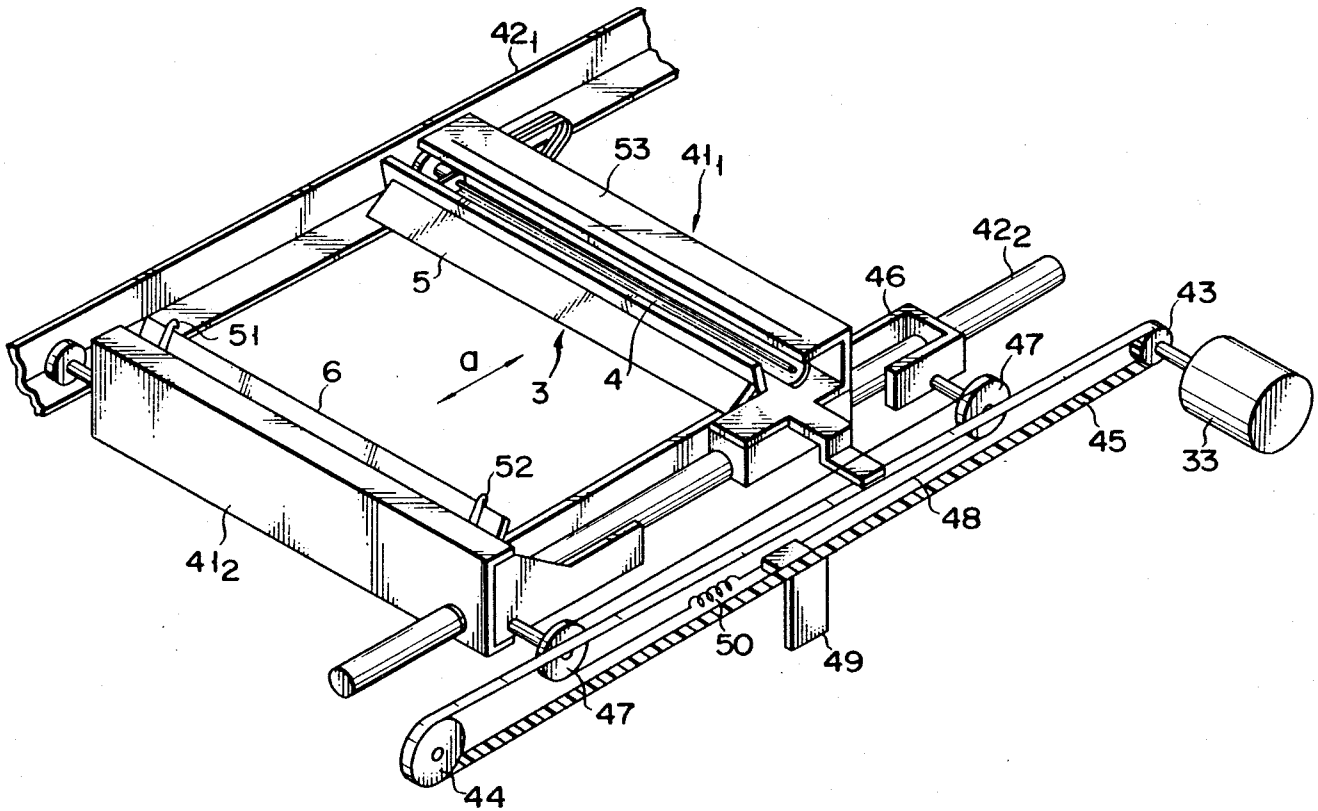

FIG. 5 shows a drive mechanism for reciprocating the optical system. The mirror 5 and the exposure lamp 4 are supported by a first carriage $41_1$, and the mirrors 6 and 7 by a second carriage $41_2$. These carriages $41_1$ and $41_2$ can move parallel in the direction indicated by arrow a, guided by guide rails $42_1$ and $42_2$. The four-phase stepping motor 33 drives a pulley 43. An endless belt 45 is stretched between the pulley 43 and an idle pulley 44, and one end of the first carriage $41_1$ supporting the mirror 5 is fixed to the middle portion of the belt 45.

On the other hand, two pulleys 47 are rotatably attached to a guide portion 46 (for the rail $42_2$) of the second carriage $41_2$ supporting the mirrors 6 and 7, spaced in the axial direction of the rail $42_2$. A wire 48 is stretched between the two pulleys 47. One end of the wire 48 is connected directly to a fixed portion 49, while the other end is connected thereto by means of a coil spring 50. The one end of the first carriage $41_1$ is fixed to the middle portion of the wire 48.

With this arrangement, when the stepping motor 33 is driven, the belt 45 turns around to move the first carriage $41_1$. As the first carriage $41_1$ travels, the second carriage $41_2$ also travels. Since the pulleys 47 then serve as movable pulleys, the second carriage $41_2$ travels in the same direction as and at a speed half that of the first carriage $41_1$. The traveling direction of the first and second carriages $41_1$ and $41_2$ is controlled by changing the rotating direction of the stepping motor 33.

The original table 2 carries thereon an indication of a reproducible range corresponding to the size of designated paper sheets. If the sheet size designated by the sheet selection keys $30_4$ and the copy ratio specified by the ratio setting keys $30_6$ or $30_7$ are (Px, Py) and K, respectively, the reproducible range (x, y) is given by $$x = Px/K,$$

$$y = Py/K.$$

Out of the coordinates (x, y) designating any point within the reproducible range, as shown in FIG. 1, the x coordinate is indicated by indexes 51 and 52 arranged on the inside of the original table 2, and the y coordinate by a scale 53 provided on the top face portion of the first carriage $41_1$.

Figure 6:
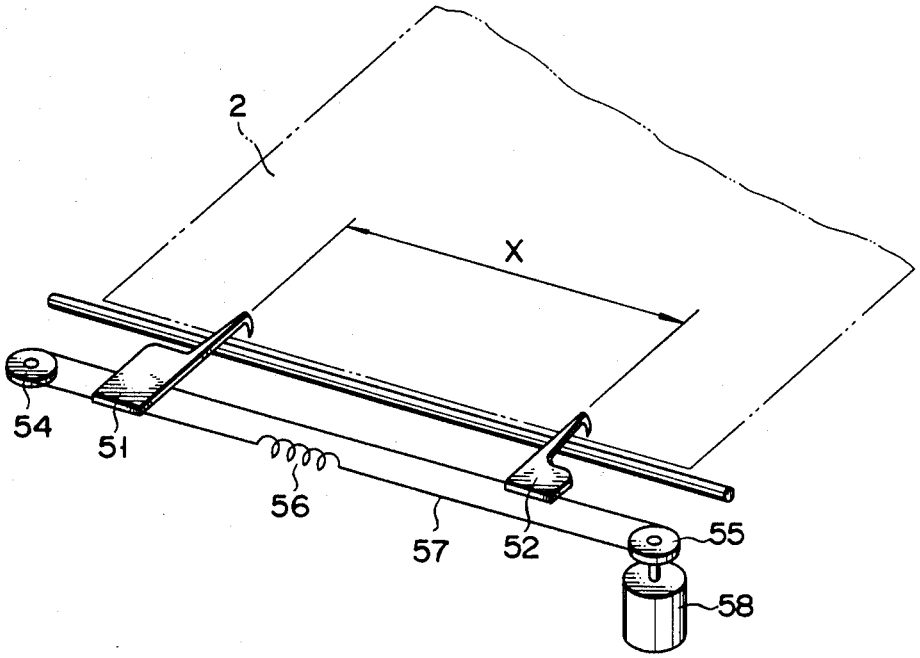

As shown in FIG. 6, the indexes 51 and 52 are attached to a wire 57 which is stretched between pulleys 54 and 55 through the aid of a spring 56. The pulley 55 is rotated by a motor 58. The distance between the indexes 51 and 52 can be changed by driving the motor 58 in accordance with the sheet size and the enlargement or reduction ratio.

The first carriage $41_1$ moves to a predetermined position (home position depending on the enlargement or reduction ratio) as the motor 33 is driven in accordance with the sheet size and the ratio. When the copy key $30_1$ is depressed, the first carriage $41_1$ is first moved toward the second carriage $41_2$. The, lamp 4 is lighted and the first carriage $41_1$ is moved away from the second carriage $41_2$. When the original scanning ends the lamp 4 is turned off, and the first carriage $41_1$ is returned to the home position.

Figure 7:
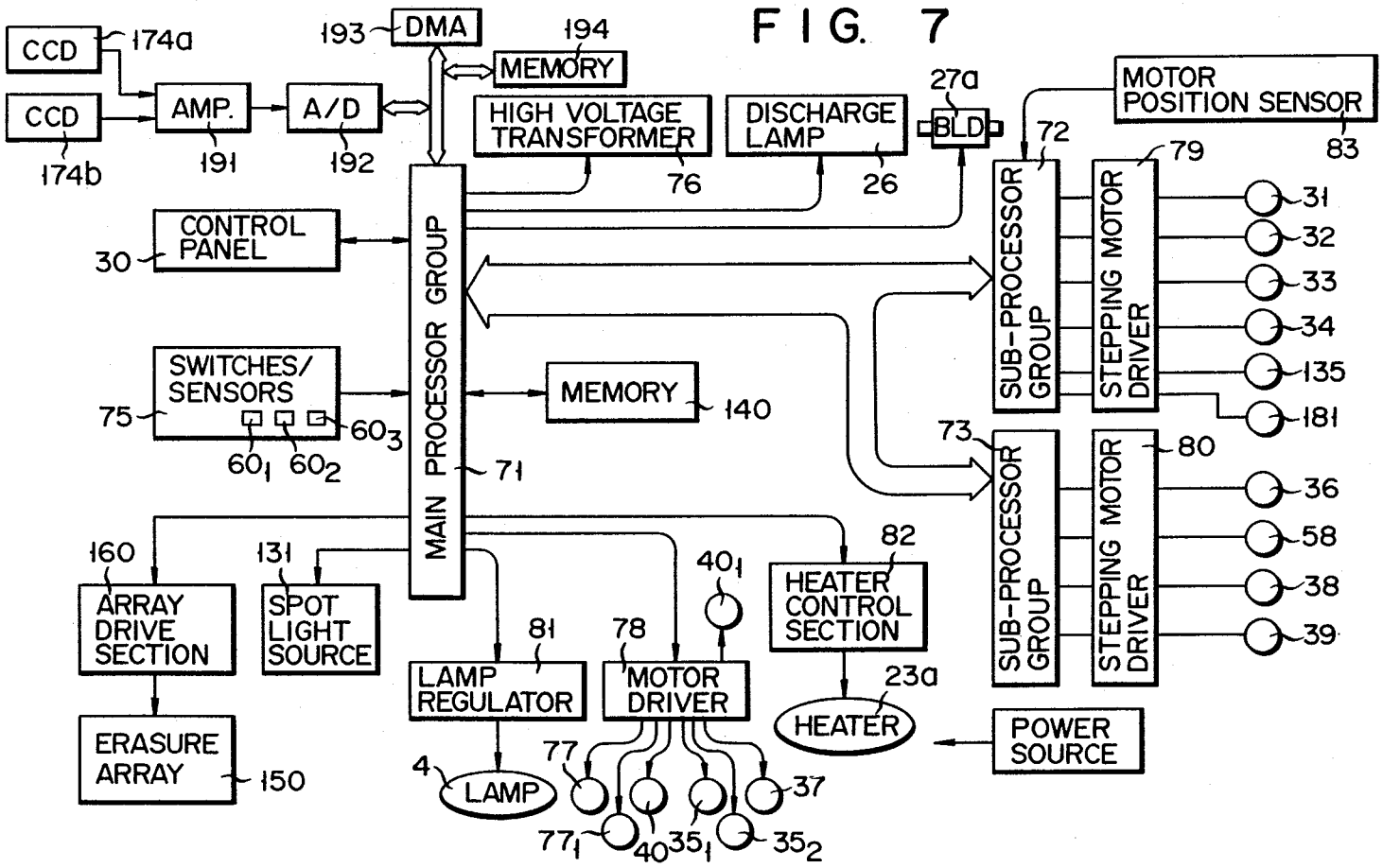

FIG. 7 shows a general control circuit of the electronic copying machine. This control circuit is mainly composed of a main processor group 71 and first and second sub-processor groups 72 and 73. The main processor group 71 detects input data from the control panel 30 and a group of input devices 75 including various switches and sensors, such as the cassette size detection switches $60_1$, $60_2$ and $60_3$ and controls a high-voltage transformer 76 for driving the charges, the discharge lamp 28, a blade solenoid 27*a* of the cleaner 27, a heater 23*a* of the fixing roller pair 23, the exposure lamp 4, and the motors 31 to 40 and 58, thus accomplishing the copying operation. The main processor group 71 also controls a spot light source 131, a stepping motor 135, an erasure array 150, an array drive section 160, and a memory 140, thereby erasing any unnecessary portions of the original. These components 131, 135, 150 and 140 will be described in detail later.

Additionally they operate to control motor 181, CCD line sensors 174*a* and 174*b*, amplifier 191, A/D converter 192, DMA (direct memory access unit) 193 and memory 194 to identify the colors of an original. Spot light source 131, pulse motor 135, erasure array 150, array driving unit 160, memory 140, pulse motors 176 and 181, CCD 174, amplifier 191, A/D converter 192, DMA 193 and memory 194 will be described later.

The motors $35_1$, $35_2$, 37, 40, and $40_1$ and toner supply motors 77, $77_1$ for supplying the toner to the developing units $12_1$ and $12_2$ are connected through a motor driver 78 to the main processor group 71 to be controlled thereby. The motors 31 and 34, 135 and 181 are connected through a stepping motor driver 79 to the first sub-processor group 72 to be controlled thereby. The motors 36, 38, 39 and 58 are connected through a stepping motor driver 80 to the second sub-processor group 73 to be controlled thereby.

Further, the exposure lamp 4 is controlled by the main processor group 71 through a lamp regulator 81, and the heater 23a by the main processor group 71 through a heater control section 82. The main processor group 71 gives instructions for the start or stop of the individual motors to the first and second sub-processor groups 72 and 73. Thereupon, the first and second sub-processor groups 72 and 73 feed the main processor group 17 with status signals indicative of the operation mode of the motors. Also, the first sub-processor group 72 is supplied with positional information from a position sensor 83 for detecting the respective initial positions of the motors 31 to 34, 135 and 181.

Figure 8:
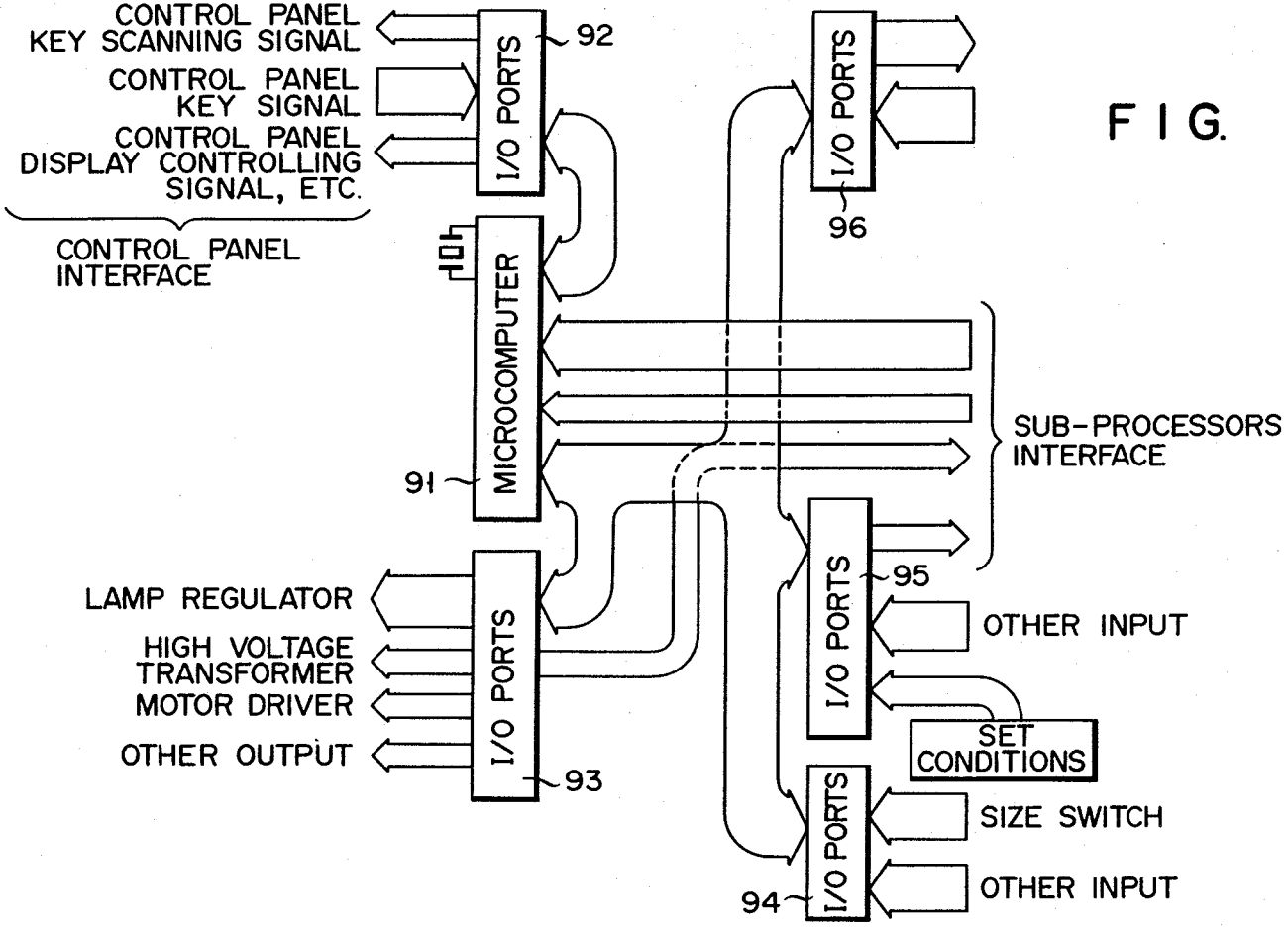

FIG. 8 shows an arrangement of the main processor group 71. Reference numeral 91 denotes a one-chip microcomputer (to be referred to as a CPU hereinafter). The CPU 91 detects key inputs at a control panel (not shown) through an I/O port 92 and controls display operations. The CPU 91 can be expanded through I/O ports 93 to 96. The port 93 is connected to a high-voltage transformer 76, a motor driver 78, a lamp regulator 81 and other outputs. The port 94 is connected to a size switch for detecting a paper size and other inputs. The port 95 is connected to a copying condition setting switch and other inputs. The port 96 is optional.

Figure 9:
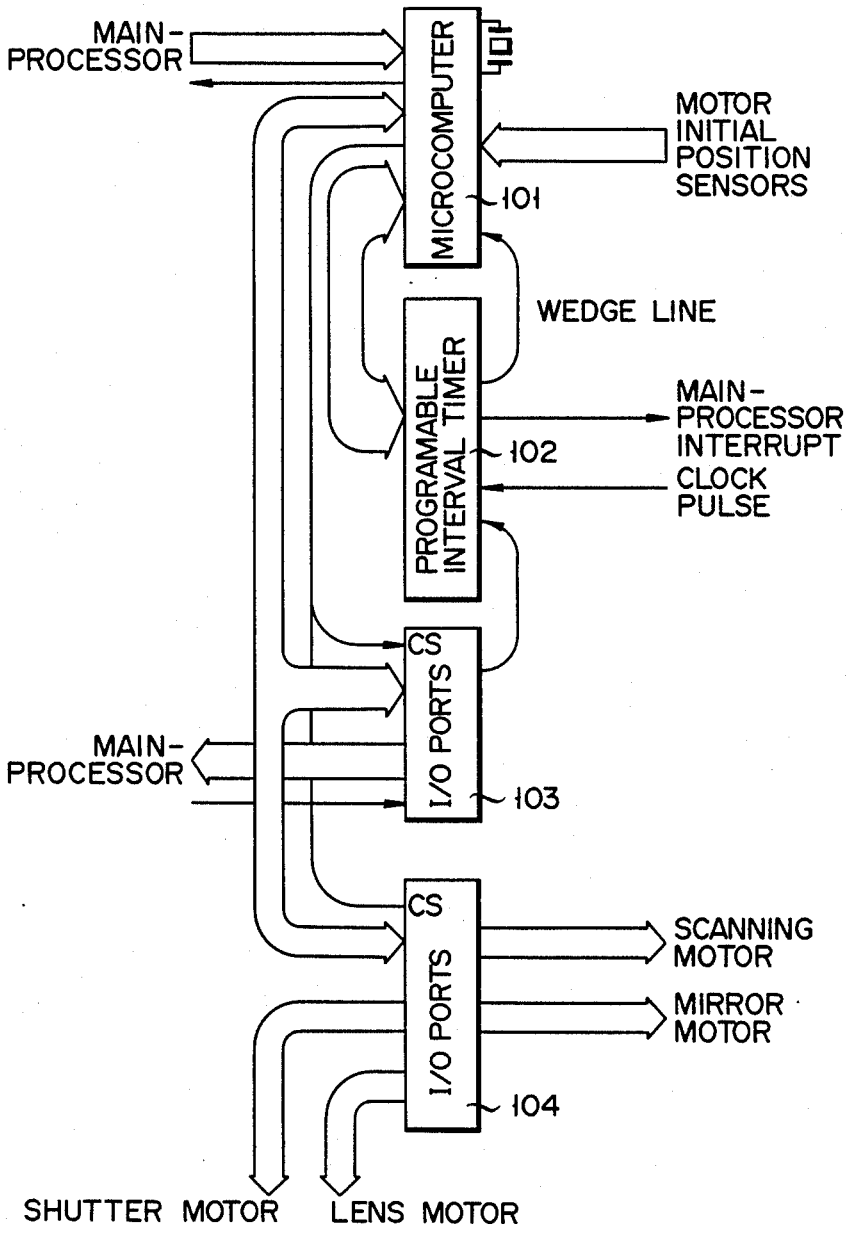

FIG. 9 shows an arrangement of the first sub-processor group 72. Reference numeral 101 denotes a CPU connected to the group 71. Reference numeral 102 denotes a programmable interval timer for controlling switching time intervals. A preset value from the CPU 101 is set in the programmable interval timer, and the time is started. When the timer is stopped, the timer sends an end pulse onto an interrupt line of the CPU 101. The timer 102 receives a reference clock pulse. The CPU 101 receives position data from a position sensor 83 and is connected to I/O ports 103 and 104. The port 104 is connected to motors 31 to 34 and 181 through the stepping motor driver 79. The port 103 is used to supply a status signal from each stepping motor to the group 71.

Figure 10:
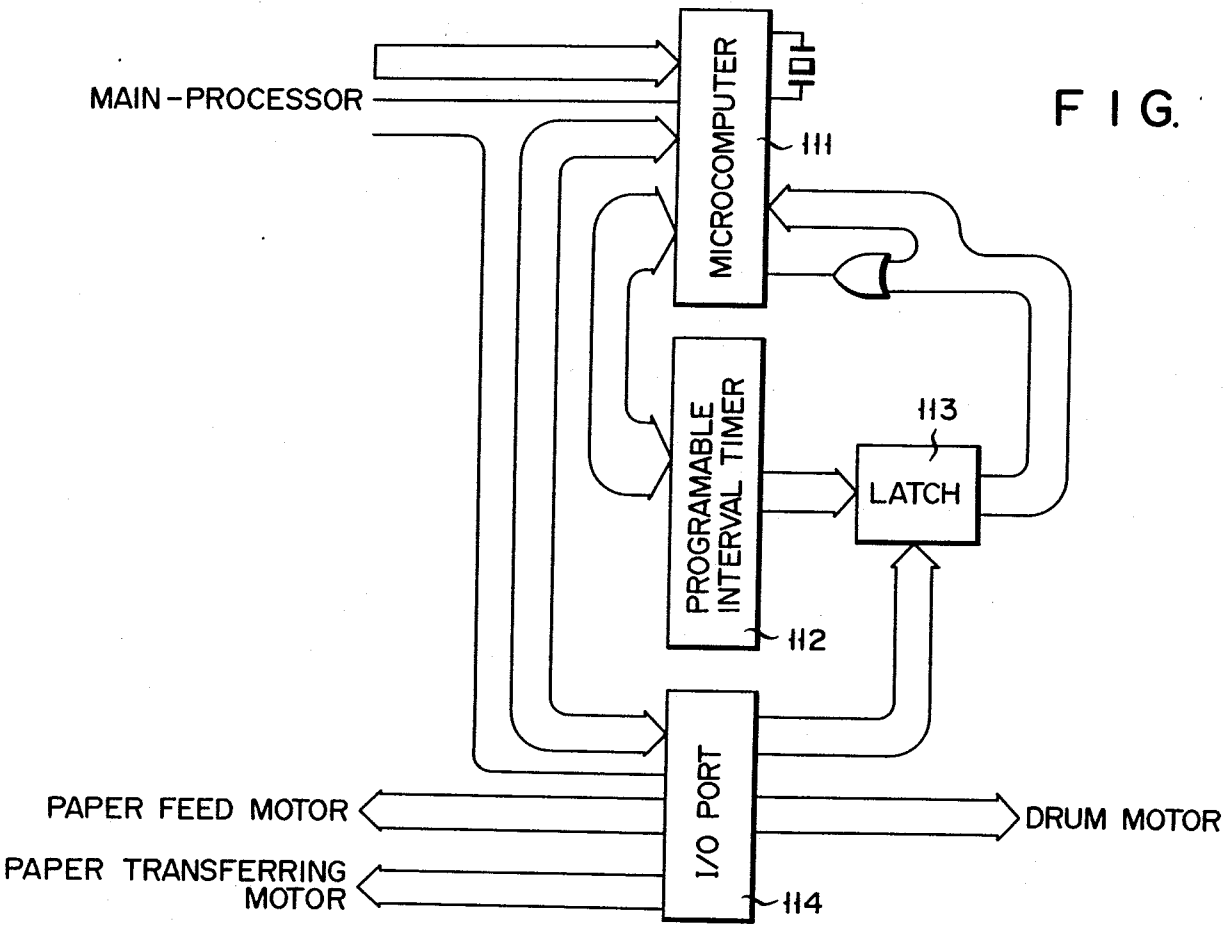

FIG. 10 shows an arrangement of the second sub-processor group 73. Reference numeral 11 denotes a CPU connected to the group 71. Reference numeral 112 denotes a programmable interval timer for controlling switching time intervals of the pulse motors. A preset value from the CPU 111 is set in the programmable interval timer, and the timer is started. When the timer is stopped, it generates an end pulse. The end pulse is latched by a latch 113, and an output therefrom is supplied onto the interrupt line of the CPU 111 and the input line of the I/O port. The CPU 111 is connected to an I/O port 114 which is then connected to motors 36, 38, 39 and 58 through the driver 80.

FIG. 11 shows a stepping motor control circuit. An I/O port 121 (corresponding to the ports 104 and 114 of FIGS. 9 and 10) is connected to a stepping motor driver 122 (corresponding to the drivers 79 and 80 of FIG. 7). The driver 122 is connected to windings A, A, B and B of a stepping motor 123 (corresponding to the motors 31 to 34, 36, 38, 39, 58, 135 and 181.

FIGS. 12A and 12B show a method of controlling a stepping motor speed. FIG. 12A shows a stepping motor speed curve, and FIG. 12B shows switching intervals. As is apparent from FIGS. 12A and 12B, the switching intervals are long at the beginning, are gradually decreased, and finally stop to decrease. Then, the intervals are prolonged, and the stepping motor is finally stopped. This cycle indicates the through-up and through-down of the pulse motor. The motor is started from the self starting region, operated in a high-speed region and is gradually stopped. Reference symbols $t_1$, $t_2$, . . . $t_x$ denote times between the switching intervals.

Indicating means and erasing means according to the present invention will now be described in detail.

Figure 13:
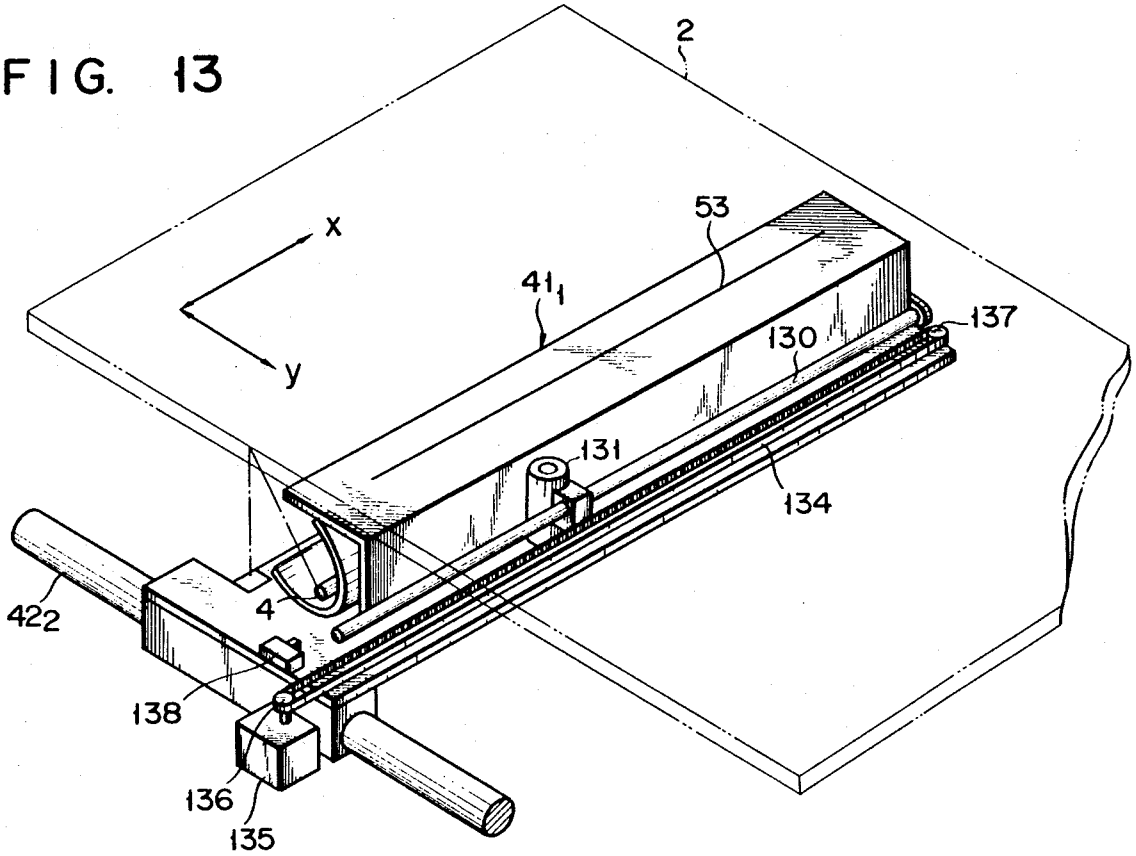
Figure 14:
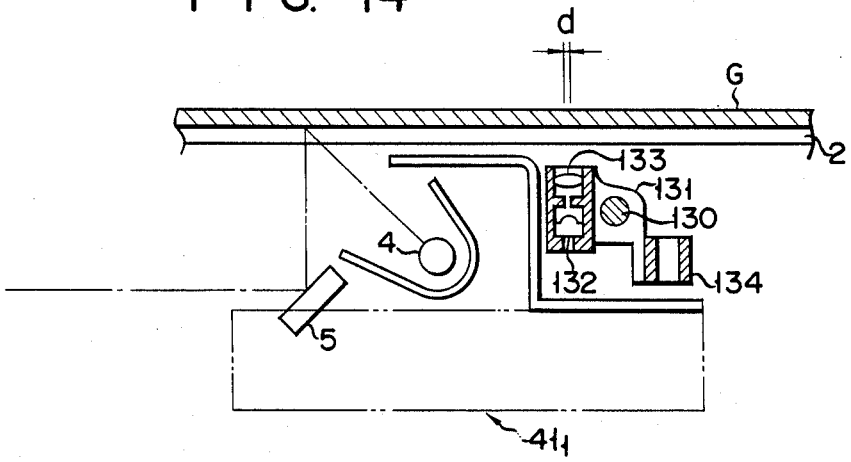

In FIGS. 13 and 14, a guide shaft 130 is disposed at that portion of the first carriage $41_1$ intercepting the light from the lamp 4, extending along the lamp 4. The guide shaft 130 is movably fitted with the spot light source 131 as the indicating means for indicating an erasure range of the original. As shown in FIG. 14, the spot light source 131 includes a light emitting element 32, such as a light emitting diode or lamp, and a lens 133 which are opposed to the original table 2.

A light beam emitted from the light emitting element 132 is applied to the original table 2 through the lens 133, as a spot light with a diameter d of, e.g., 2 mm. The spot light has enough brightness to be transmitted through an original G as thick as, e.g., a postcard set on the original table 2. The spot light source 131 is coupled to a timing belt (toothed belt) 134 extending along the guide shaft 130. The timing belt 134 is stretched between a pulley 136 mounted on the shaft of the stepping motor 135 and a driven pulley 137. As the stepping motor 135 is rotated the spot light source 131 is moved in a direction perpendicular to the scanning direction of the first carriage $41_1$.

A position sensor 138 formed of a microswitch for detecting the initial position of the spot light source 131 is attached to that portion of the first carriage $41_1$ which is located beside the end portion of the guide shaft 130 on the side of the stepping motor 135. When the spot light source 131 is moved, for example, it first abuts against the position sensor 134 to have its initial position detected thereby.

Figure 15:
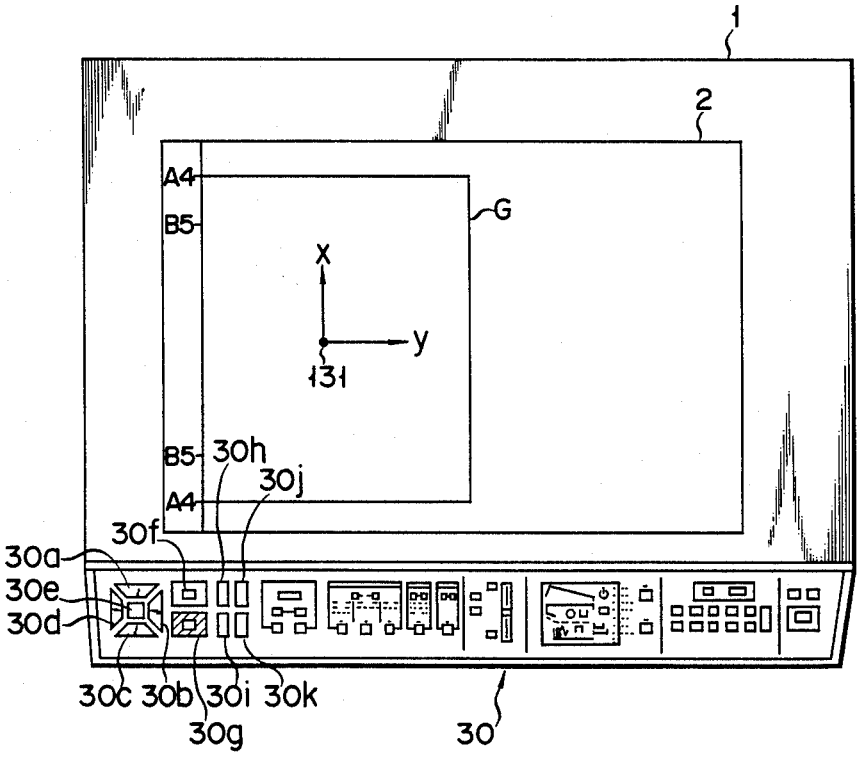
Figure 16:
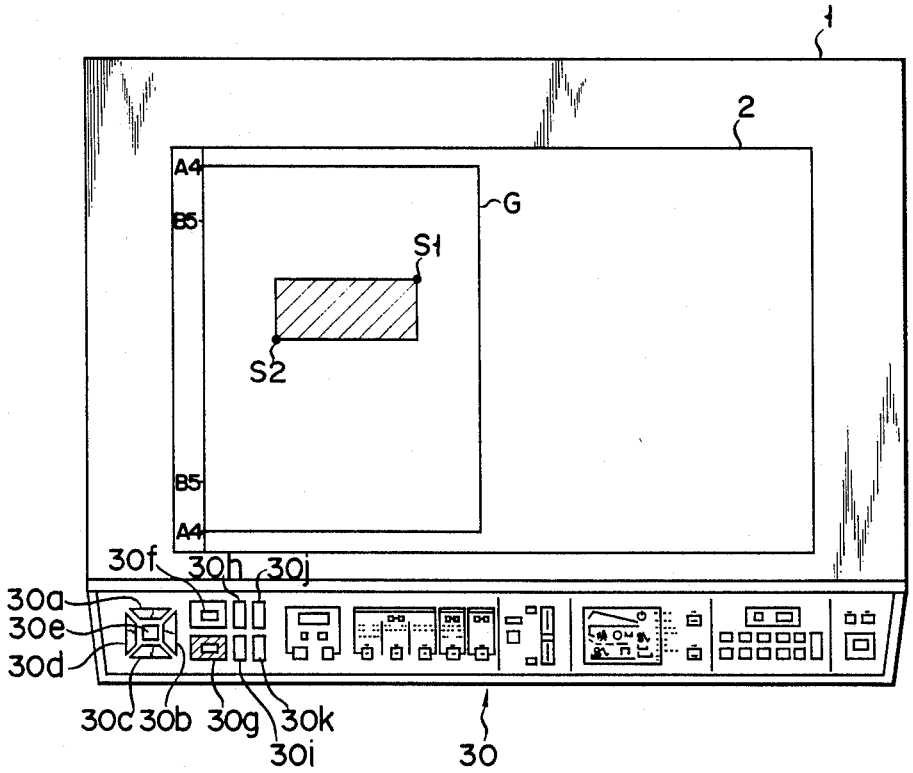
Figure 17:
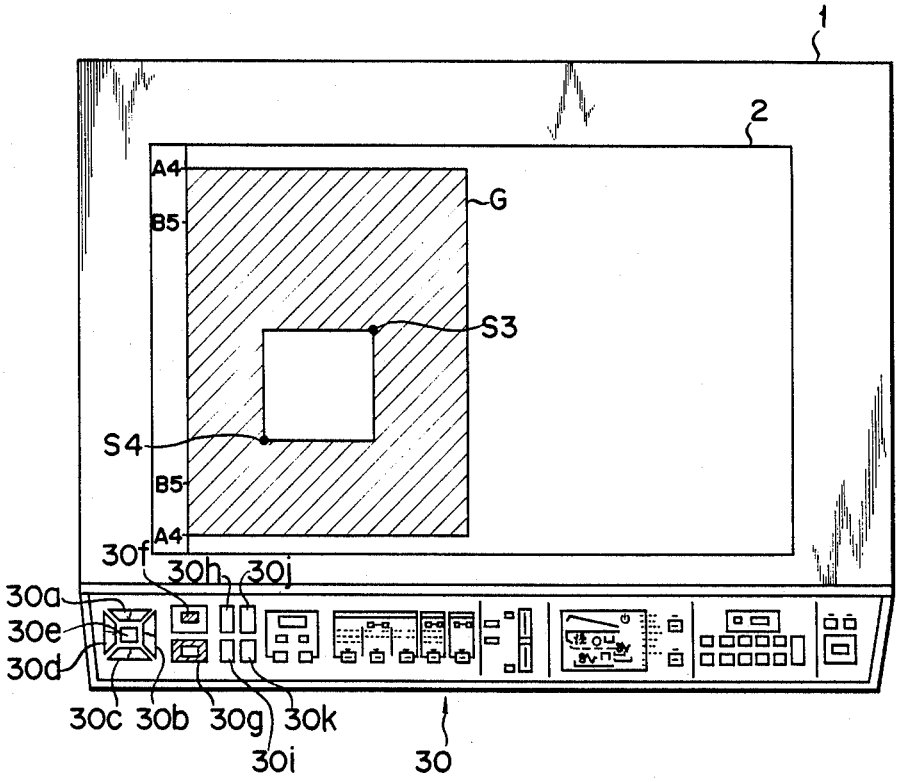

Referring now to FIGS. 15 to 17, there will be described a method for designating the erasure range of the original by means of the spot light source 131.

The spot light source 131 is moved by operating the operation keys **30*a* to 30*d*. When the operation keys 30*b* and 30*d* are depressed, the motor 33 is started, and the first carriage $41_1$ and the spot light source 131 are moved in the scanning direction (indicated by arrow y in FIG. 15). When the operation keys 30*a* and 30*c* are depressed, on the other hand, the motor 135 is started, and the spot light source 131 is moved in a direction (indicated by arrow x in FIG. 15**) perpendicular to the scanning direction.

Observing the spot light transmitted through the original G, the operator operates the operation keys **30*a* to 30*d*. When the spot light reaches, for example, a spot S1 on the original G shown in FIG. 16, the operator depresses the position designating key 30***e*. Thereupon, the coordinate position (x1,y1) indicated by the spot S1 is stored in the main processor group 71 shown in FIG. 7. Likewise, if the position designating key 30*e* is depressed when a spot S2 on the original G is reached by the spot light, the position (x2,y2) of the spot S2 is stored in the main processor group 71. This position of the spot light can be detected by, for example, counting drive pulses delivered from the stepping motors 33 and 135. When the erasure range designating key 30*f* is depressed thereafter, a rectangular region (hatched region) having its two opposite vertexes on the spots S1 and S2 is designated as the erasure range, as shown in FIG. 16.

If the erasure range designating key 30*g* is depressed after designating spots S3 and S4 on the original G, the other region of the original G (i.e., not a square region having its two opposite vertexes on the spots S3 and S4) is designated as the erasure range, as shown in FIG. 17.

Figure 18A:
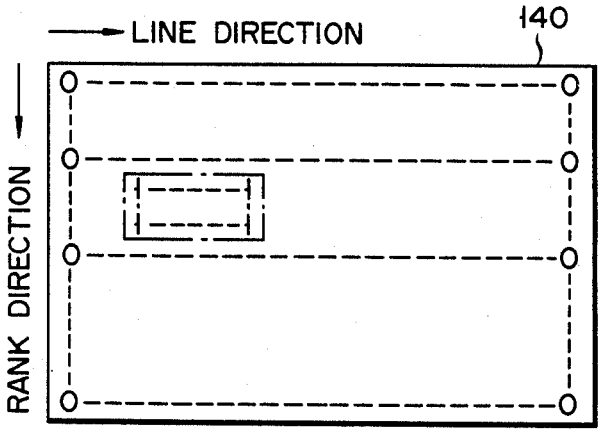
FIGS. 18A and 18B are plan views for explaining memory contents.
Figure 18B:
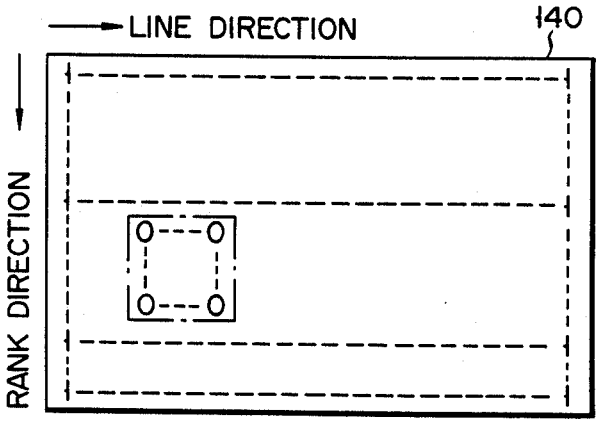

Thus, if the key 30*f* or 30*g* is depressed, the group 71 performs arithmetic operation in accordance with the specified two positions. Position data of the erasure area are set at logic "1" and position data of an area excluding the erasure area are set at logic "0". These position data are stored in the memory 140. A rank capacity of the memory 140 substantially corresponds to a value given by (moving distance of the source 131 along the x direction)÷(position resolution along the x direction). A line capacity of the memory 140 substantially corresponds to a value given by (moving distance of the source 131 along the y direction)÷(position resolution thereof along the y direction). The memory 140 comprises a RAM having the memory capacity described above. In the cases of FIGS. 16 and 18, high level signals are stored at addresses corresponding to the hatched area and low level signals are stored at other addresses in response to the data supplied from the group 71, as shown in FIGS. 18A and 18B, respectively.

In this manner, the original is placed on the original table such that the image surface face upward. When an erasure area is specified, the original is turned over along fixed scale $2_1$ on table 2. Therefore, information stored in memory 140 shown in FIGS. 18A and 18B is stored such that column order is inverted in practice.

Figure 19A:
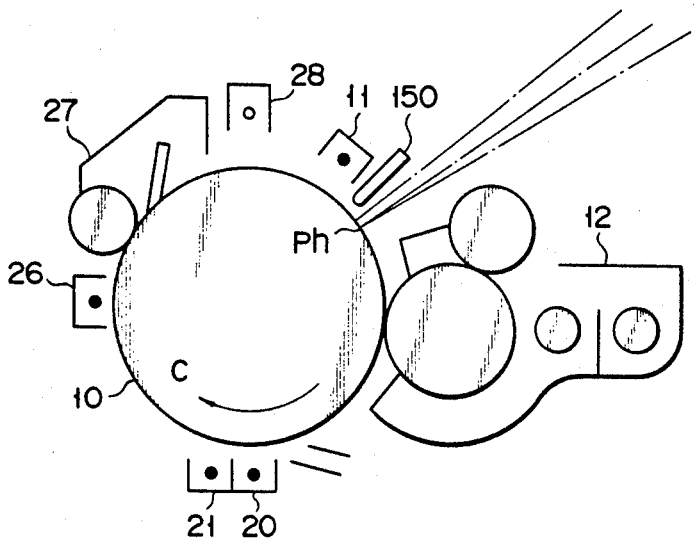
FIG. 19A is a side sectional view of the principal part showing an arrangement of the erasure array.
Figure 20:
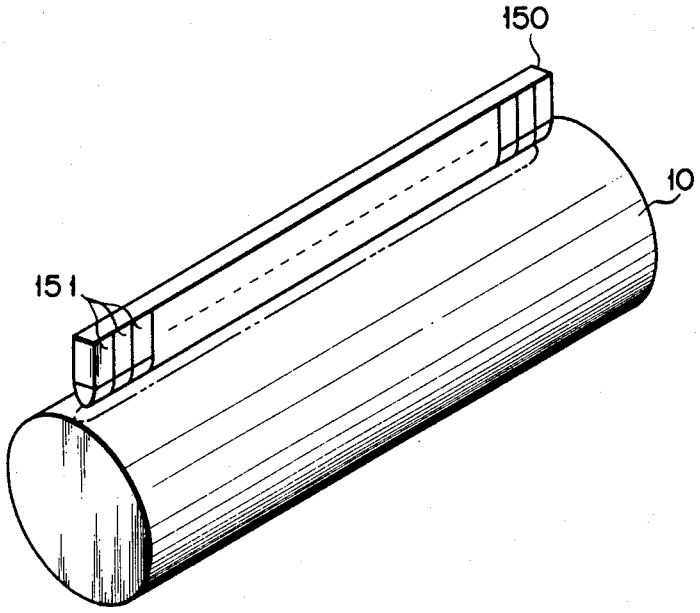
Figure 21:
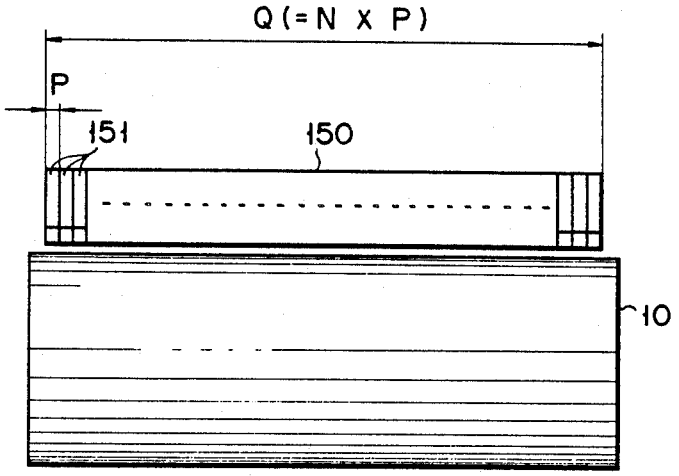
Figure 22A:
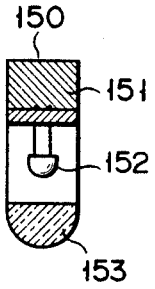
FIG. 22A is a side sectional view of the erasure array.
Figure 22B:
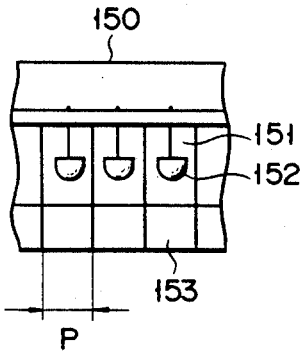
FIG. 22B is a partial front view of the erasure array.

As shown in FIG. 19A, on the other hand, the erasure array 150 as the erasing means is disposed close to the photosensitive drum 10, between the charger 11 and an exposure region Ph, for example. As shown in FIGS. 20 and 21, the erasure array 150 includes a plurality of shading cells 151 which are arranged in a direction perpendicular to the rotating direction of the photosensitive drum 10. As shown in FIGS. 22A and 22B, the cells 151 each contains therein a light emitting element 152 formed of, e.g., a light emitting diode. Moreover, a lens 153 for converging light from the light emitting element 152 on the surface of the photosensitive drum 10 is disposed at the opening portion of each cell 151 facing the photosensitive drum 10.

The number of light-emitting elements arranged in erasure array 150 corresponds to the same as the column capacity of memory 140. When the distance between light-emitting elements 152 is given by P and the number of elements is given by N, overall length Q of array 150 is given by Q=N.P.

Figure 23:
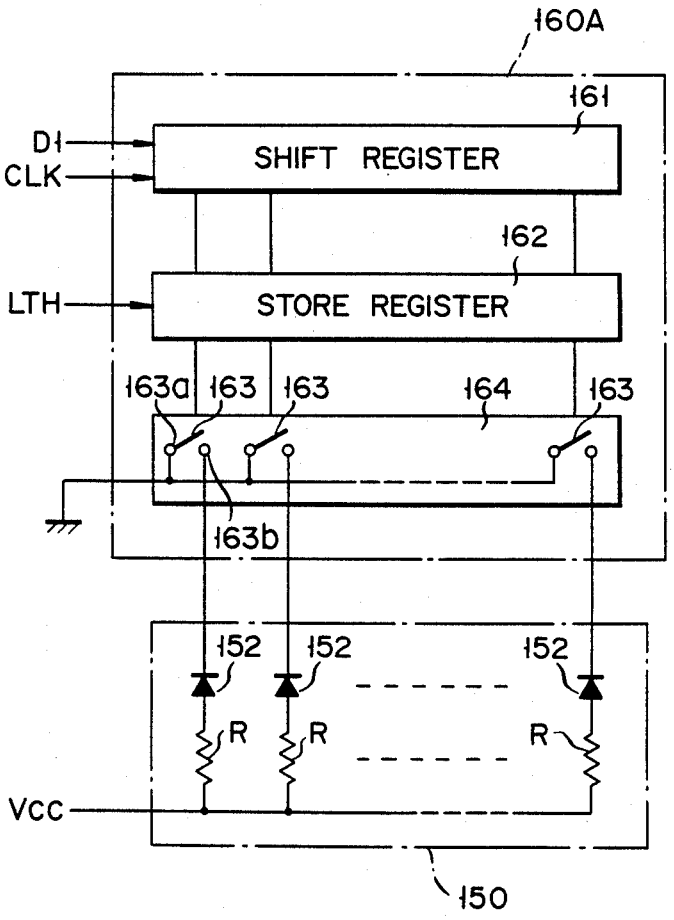

The array 150 is driven by an array drive section 160. As shown in FIG. 23, the section 160 comprises a shift register 161 having the same bit number as the rank bit number of the memory 140, a store register 162 for storing the content of the register 161, and a switching circuit 164 consisting of a plurality of switch elements 163 which are turned on/off in response to output signals from the register 162. Movable contacts 163*a* of the elements 163 are grounded, and stationary contacts 163*b* thereof are respectively connected to the cathodes of the elements (diodes) 152 constituting the array 150. The anodes of the elements 152 are connected to a power source VCC through the corresponding current limiting resistors R.

After, as the erasure area the unnecessary portion of the original is specified, he closes the original cover $1_1$ and depresses the key $30_1$. The carriage $41_1$ and drum 10 are driven, and one-rank data are sequentially read out along the line direction (FIGS. 18A and 18B of the memory 140. The readout data D1 are transferred to the register 161 in the section 160 in response to the clock signal CLK. After one-rank data is transferred to the register 161 and the charged portion of the drum 10 reaches the array 150, the group 71 generates a latch signal LTH. The storage data is supplied from the register 161 to the register 162 in response to the latch signal LTH. Since the array 150 is arranged between the charger 11 and the exposure portion Ph, the output timing of the latch signal LTH is controlled such that the one-rank data is transferred from the memory 140 to the register 162 prior to $\theta 1/\omega$ where $\theta 1$ is the angle between the array 150 and the portion Ph and $\omega$ is the peripheral velocity of the drum 10.

The elements 163 in the circuit 164 are controlled in response to the output signal from the register 162. When the output of the register 162 is set at high level, the elements 163 are turned on. When the output of the register 162 is set at low level, the elements 163 are turned off. The elements 152 connected to the elements 163 are turned on when the elements 163 are turned on. Otherwise, the elements 152 are turned off. A charged drum portion corresponding to the ON elements 152 is discharged, and the remaining portion is not discharged, so that a latent image is not formed in the discharged portion even if the surface of the drum 10 is exposed with light. In this manner, the unnecessary portion for one rank if erased. The data is thus read out from the memory 140 in units of ranks, thereby erasing the unnecessary image portion.

Figure 24:
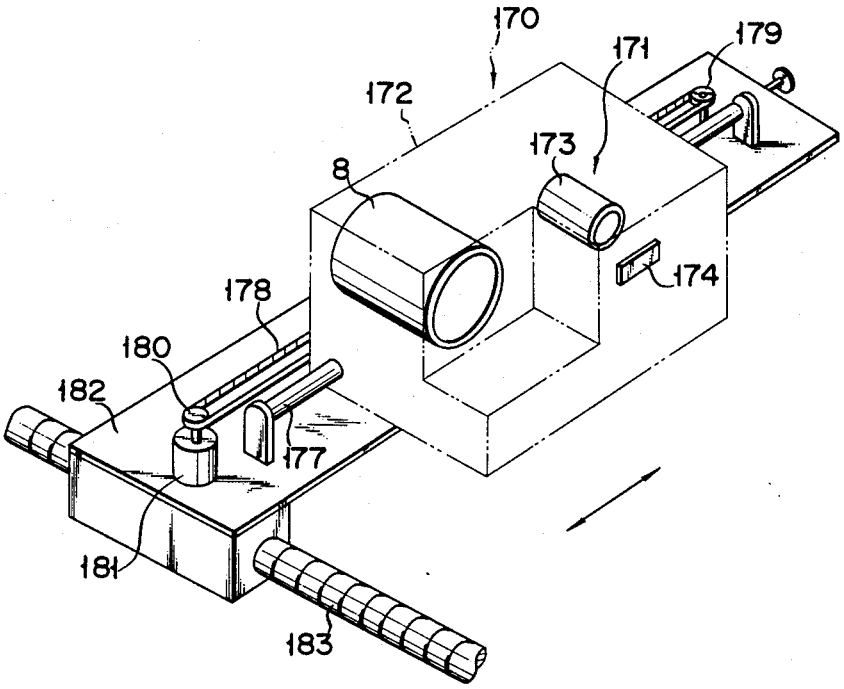

Next, the main feature of the present invention will now be described. In this invention, when color copying is specified by color specifying key 30*i* on control panel 30, lens unit 170 is moved, lens block 8 is removed outside the optical path connecting mirrors 7 and $9_1$ (FIG. 2), and photoelectrically converting (CCD) unit 171 is inserted in the optical path, thus allowing color copying. Lens unit 170 has a structure shown in FIG. 24. More specifically, lens block 8 and CCD unit 171 are arranged inside case 172 parallel to each other. Unit 171 consists of focusing lens 173 for guiding an optical image from mirror 7, and CCD means 174 on which the optical image is focused. Case 172 is slidably held by guide shaft 177, which is arranged to be orthogonal to the optical axis of lens block 8, and is fixed to timing belt 178 arranged along guide shaft 177. Timing belt 178 is looped between pulleys 179 and 180, and pulley 180 is driven by stepping motor 181. Therefore, when motor 181 is driven, lens unit 170 is moved along guide shaft 177 in the direction indicated by the arrow in FIG. 24. Guide shaft 177, stepping motor 181, and the like are mounted on base 182, which threadably engages with screw bolt 183 driven by motor 31. When screw bolt 183 is rotated, base 182 is moved in the direction along the optical axis of lens block 8, thereby moving lens block 8 at a position corresponding to a set copying magnification.

Figure 25A:
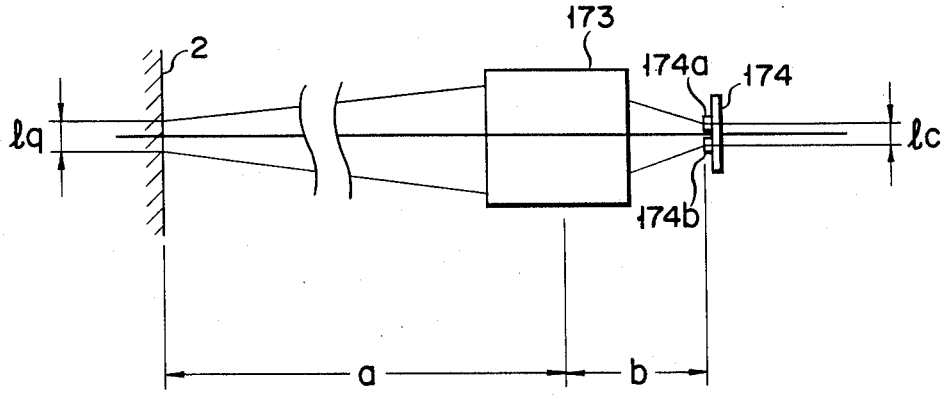
FIGS. 25A and 25B are schematic illustrations showing a photoelectrically converting unit.
Figure 25B:
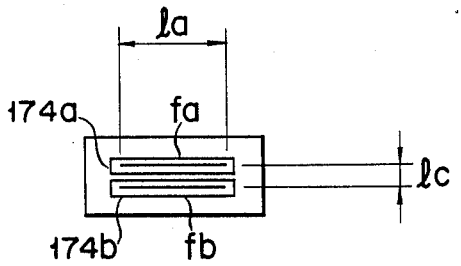

CCD means 174 has an arrangement shown in FIGS. 35A and 25B. More specifically, CCD means 174 consists of two CCD line sensors 174*a* and 174*b* arranged adjacent to each other along the moving direction of first carriage $41_1$. CCD line sensors 174*a* and 174*b* respectively have filters fa and fb having different wavelengths. Filters fa and fb are used for red and gray filters or gray and blue filters, respectively.

If a distance between CCD line sensors 174*a* and 174*b* is given by lc, distance lq between sensors 174*a* and 174*b* on an original surface (original table 2) is expressed by the following relation if a focal length of focusing lens 173 is given by f:

$$1/a+1/b=1/f$$

$$a/b=lq/lc$$

Where length la of sensors 174*a* and 174*b* corresponds to the maximum width of an original. Since distance lc between sensors 174*a* and 174*b* is about 1 to 2 mm and length la of sensors 174*a* and 174*b* is about 28 mm, if the maximum size of an original is an A3 size, distance lq on the original is expressed by:

$$lq \approx 210\times(1 \text{ to } 2)/28=7.5 \text{ to } 15 \text{ mm}$$

Figure 26A:
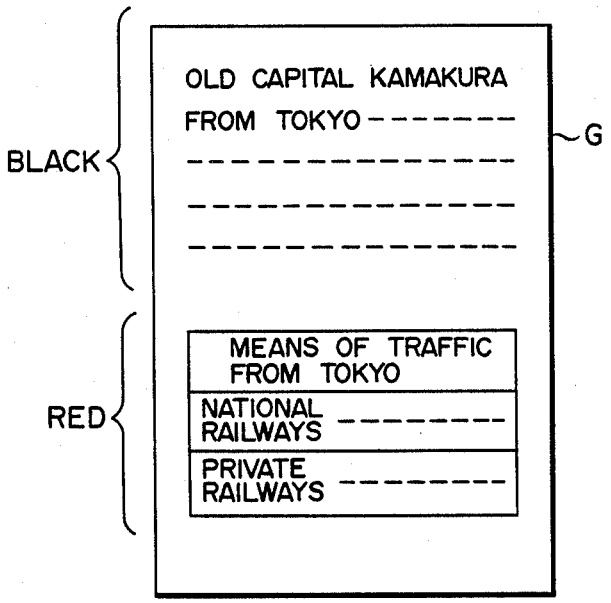

The color copying operation of the apparatus with the above arrangement will now be described. As shown in FIG. 26A, when original G having red and black colors is to be copied, original G is placed on original table 2 and color specifying key 30*i* and copying key $30_1$ are depressed successively to perform the control operation shown in FIG. 27. In step ST1, lens unit 170 is moved as shown in FIG. 28A, lens block 8 is removed from the optical path between mirrors 7 and $9_1$, and CCD unit 171 is inserted in the optical path. Thereafter, if it is determined in step ST2 that copying key $30_1$ is depressed, first carriage $41_1$ is moved toward fixed scale $2_1$ as indicated by arrow y2 in FIG. 28C while photosensitive drum 10 is stopped, thus performing exposure scanning of original G. Upon this scanning operation, light emerging from lens 173 is guided to CCD line sensors 174*a* and 174*b* through filters fa and fb, respectively. CCD output signals from sensors 174*a* and 174*b* are supplied to A/D converter 192 through amplifier 191 (FIG. 7), and are converted into digital signals. The digital signals are stored in different storage areas in memory 194 through DMA 193.

As described above, the distance between sensors 174*a* and 174*b* is lc and corresponds to distance lq on the original surface. If moving speed vc of first carriage $41_1$ is constant, when the same portion of the original is photoelectrically converted by sensors 174*a* and 174*b*, delay time t=lq/vc is generated between sensors 174*a* and 174*b* due to the presence of distance lq. Therefore, if A/D converter 192 or the like is operated taking the delay time into consideration, the signals output from sensors 174*a* and 174*b* can be processed. The delay time can be determined by counting the number of pulses supplied to stepping motor 33 for driving first carriage $41_1$.

Figure 26B:
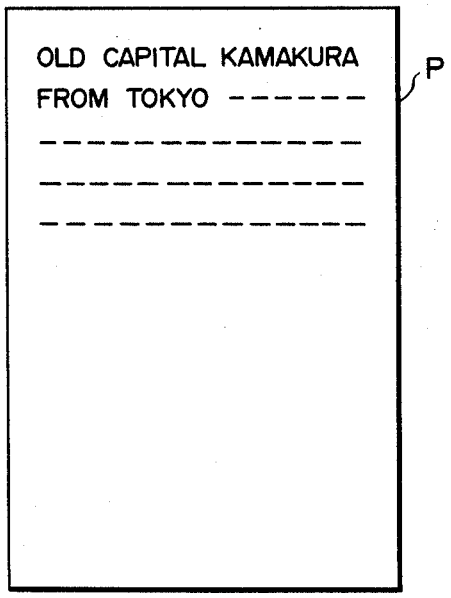
Figure 26C:
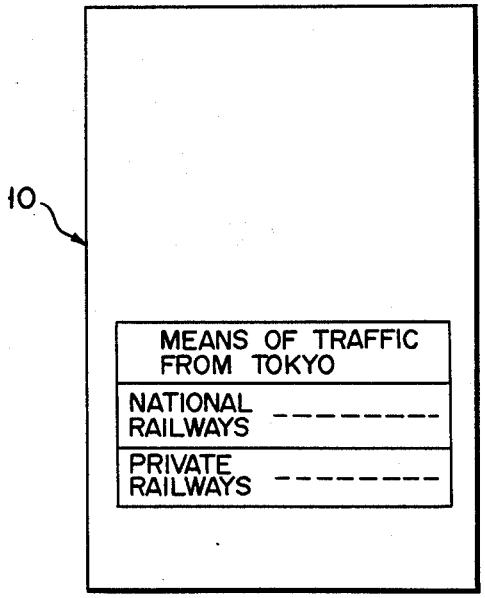
Figure 28A:
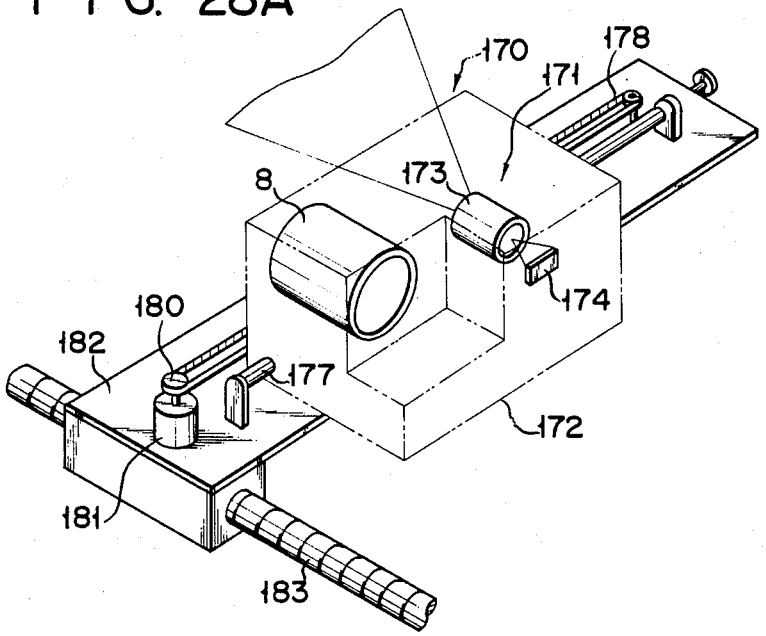
Figure 28B:
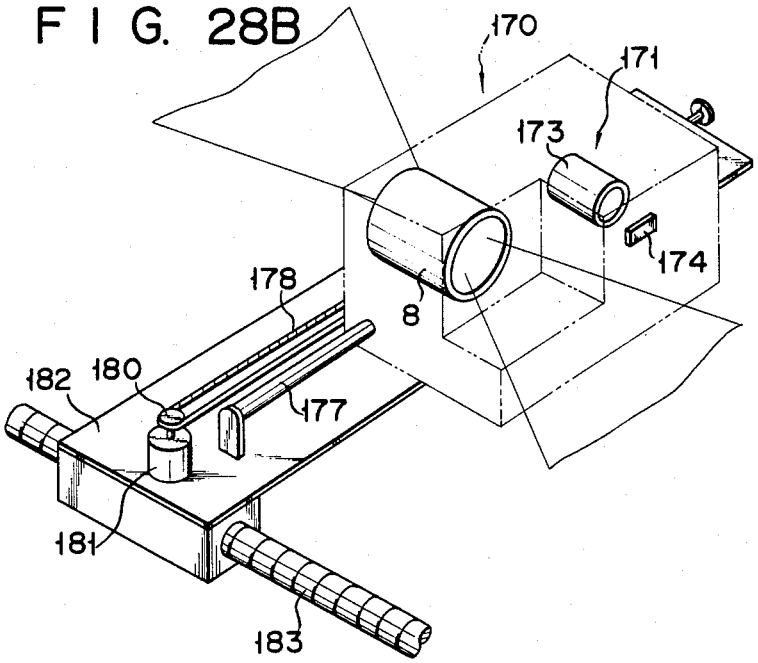
Figure 28C:
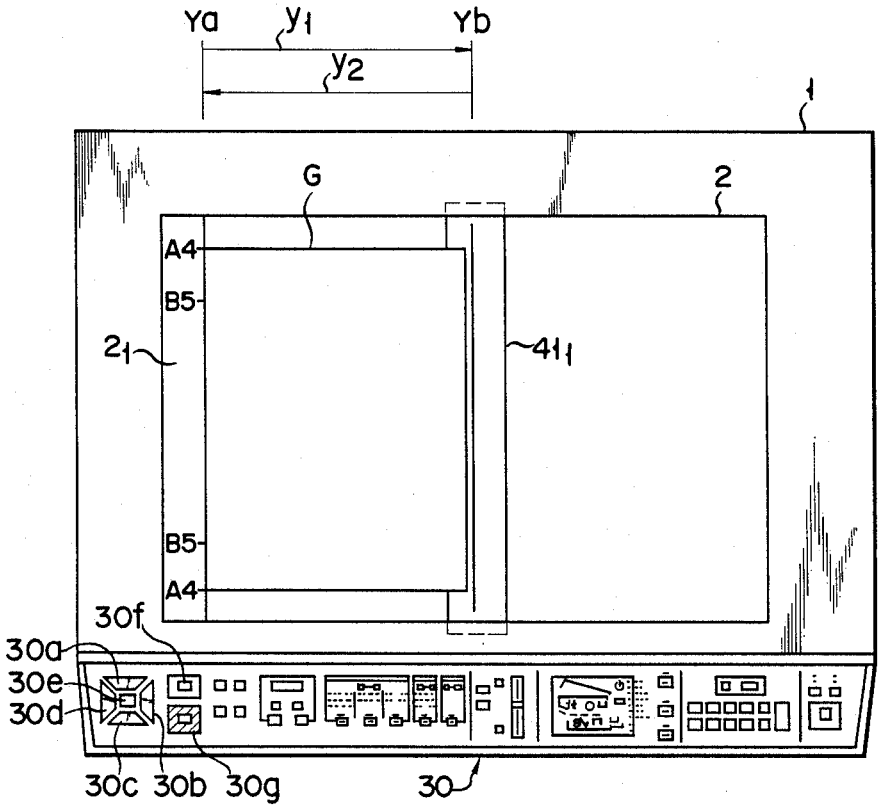

In this state, when first carriage $41_1$ reaches position Ya in FIG. 28C and the scanning operation of original G is completed, color identification processing of the image data stored in memory 194 is performed in step ST4. Two different data stored in memory 194 are added to each other or subtracted from each other to identify the black and red areas of the original image, and positional data of the black and red areas of original G is stored in memory 194. For the positional data to be used for the purpose as described above, two distant storage areas having a storage capacity which corresponds to the image resolution of the original may be provided in memory 194, where high level signals are stored for the red area of the original image and low level signals for the rest of the area of the original image in one of the storage area and high level signals are stored for the black area of the original image and low level signals for the rest of the areas of the original image in the other storage area. Thereafter, in step ST5, lens unit 170 is moved as shown in FIG. 28B, and CCD unit 171 is removed from the optical path between mirrors 7 and $9_1$, and lens block 8 is inserted in the optical path. Next, in step ST6, erasure data for the red area is generated and stored in memory 140. Under this condition, a copying operation is conducted for the black area of original G by means of black toner containing developing unit $12_2$ and erasure array 150. More specifically, first carriage $41_1$ is moved from position Ya in the direction indicated by arrow y1 in FIG. 28C to perform exposure scanning. As a result, erasure data is supplied to erasure array 150 from memory 140, and the electric charges for the red area are erased from the surface of photosensitive drum 10. Thus, only the black area of original G is copied on paper P as shown in FIG. 26B. In step ST7, paper P on which only the black area has been copied is again transferred to the transfer charger by multiple copying unit 128. In step ST8, erasure data for the black area is generated and stored in memory 140 based on the positional data stored in memory 194. In this state, a copying operation is conducted for the red area of original G by means of red toner containing developing unit $12_1$ and erasure array 150. More specifically, first carriage $41_1$ is moved from position Ya in the direction indicated by arrow y1 in FIG. 28C to perform exposure scanning of original G. As a result, erasure data is supplied to erasure array 150 from memory 140 and the electric charges for the black area are erased from the surface of photosensitive drum 10. Therefore, only the red area of original G is formed on the surface of the photosensitive drum 10, as shown in FIG. 26C. In synchronism with this operation, paper P that has been transferred to the transfer charger by means of multiple copying unit 128 is fed, and the red area of original G is copied thereon. Thus, the full image which is composed of red and black areas and exactly identical with that of the original G that has been formed on paper P. Finally, in step ST9, paper P is sent to paper discharger tray 25 by way of paper exit roller pair $60_4$.

It should be noted that in this embodiment, if monocolor specifying key 30*h* is depressed, an ordinary multiple copying operation is selected and, by depressing red specifying key 30*j* or black specifying key 30*k*, a monocolor copying operation is carried out using red or black toner.

In the embodiment described above, the colors and the position of the original image are identified by CCD unit 171, and the color and positional data thus obtained are used to appropriately control developing units $12_1$ and $12_2$, erasure array 150, and multiple copying unit 128. Therefore, any color of the original can be selectively chosen to form a copied image so that eventually, a full color copy may be obtained. In addition, CCD unit 171 comprises two CCD line sensors 174*a* and 174*b* respectively having two different color filters fa and fb. Since the same portion of the original image can be scanned by a single exposure scanning operation due to the presence of the delay time of sensors 174*a* and 174*b*, high-speed, accurate scanning operation is allowed, and a color copying operation can be performed within a short period of time.

Since focusing lens 173 is combined with sensors 174*a* and 174*b*, the positional relationship therebetween can be accurately held. In addition, since CCD unit 171 consisting of focusing lens 173 and line sensors 174*a* and 174*b* is arranged inside case 172 integrally with lens block 8, lens block 8 and unit 171 can be easily moved.

In this embodiment, since a copying machine which uses ordinary toner agents is incorporated, its construction is relatively simple and hence can be realized less expensively.

Figure 29A:
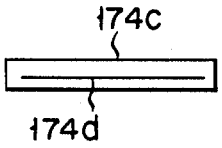
Figure 29B:
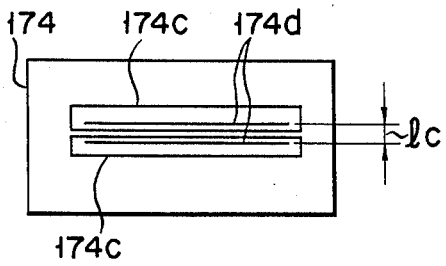

Another embodiment of the present invention will now be described. FIGS. 29A and 29B show another embodiment of CCD means 174. As shown in FIG. 29A, light receiving section 174*d* of CCD line sensor 174*c* is arranged not at the center thereof but at its one side portion. In this embodiment, when two CCD line sensors 174*c* are arranged parallel to each other as shown in FIG. 29B, distance lc between light receiving sections 174*d* can be decreased when compared with the above embodiment. The scanning delay time of CCD line sensors 174*c* can thus be shortened. Therefore, in, e.g., a copying machine with automatic exposure for automatically controlling illuminance of exposure lamp 4, a difference between densities of the original image scanned by sensors 174*c* can be reduced.

Figure 30:
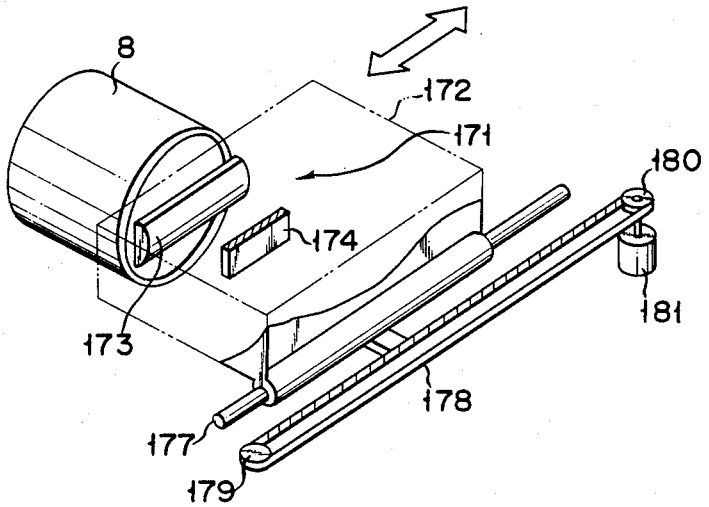

In the above embodiment, lens block 8 and CCD unit 171 are integrally arranged inside case 172. The present invention is not limited to this. As shown in FIG. 30, for example, lens block 8 and CCD unit 171 are separately arranged, and only CCD unit 171 is arranged in case 172, so that CCD unit 171 can be inserted in the optical axis of lens block 8 as desired.

Figure 19B:
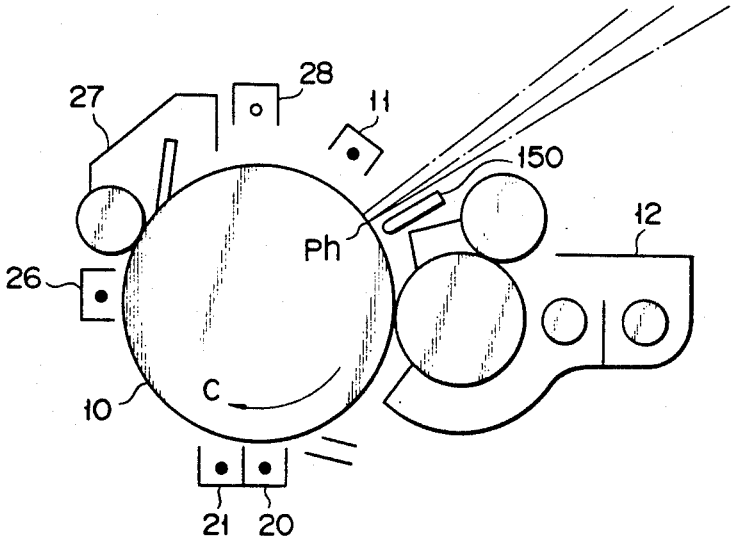
FIG. 19B is a side sectional view of the principal part showing another arrangement of the erasure array.

Location of erasure array 150 is not limited to that shown in FIG. 18A, and can be selected somewhere between exposure section Ph and developing unit $12_1$, as shown in FIG. 19B, so that any part of the formed electrostatic latent image can be erased as needed.

It will not be necessary to say that various modifications are possible within the scope of the present invention.

A modification that is applicable to the present invention will be described.

Figure 31:
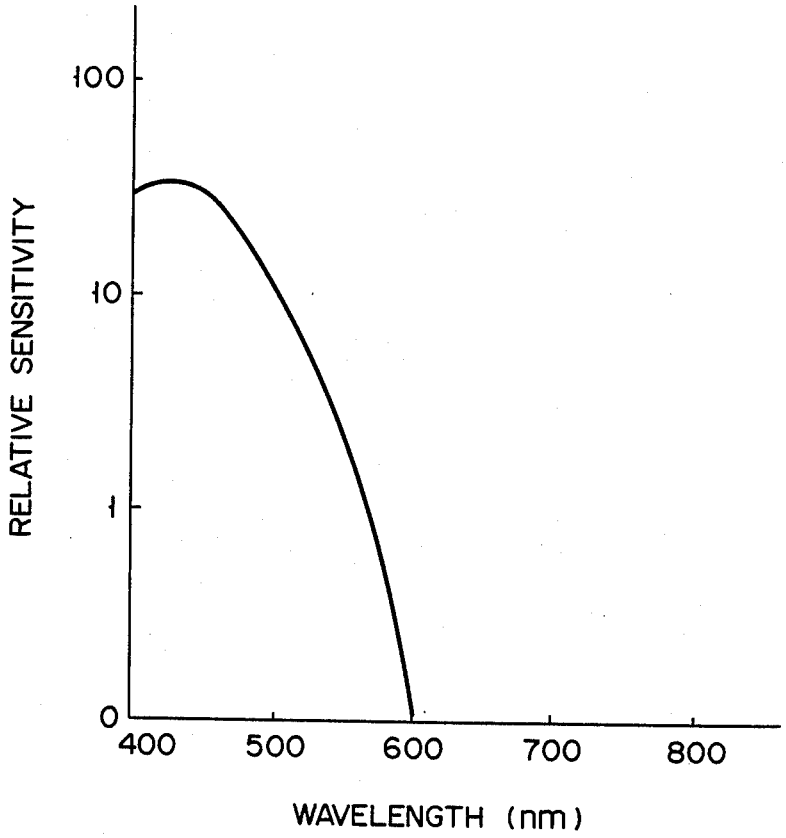

In this modification, the area of an original image that is to be erased is framed by an ink of specific type. The ink for specifying an erasure area has spectral characteristic of reacting to CCD line sensor 174*a* or 174*b* but not reacting to photosensitive drum 10. For example, if photosensitive drum 10 is of the selenium (Se) type, since it is highly sensitive to blue light, as shown in FIG. 31, a special pen containing blue ink with wavelength of 400 to 500 (nm) is used.

Figure 32A:
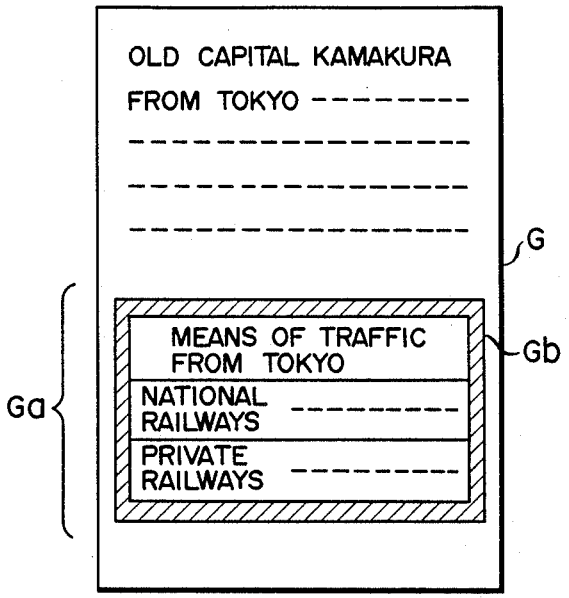
Figure 32B:
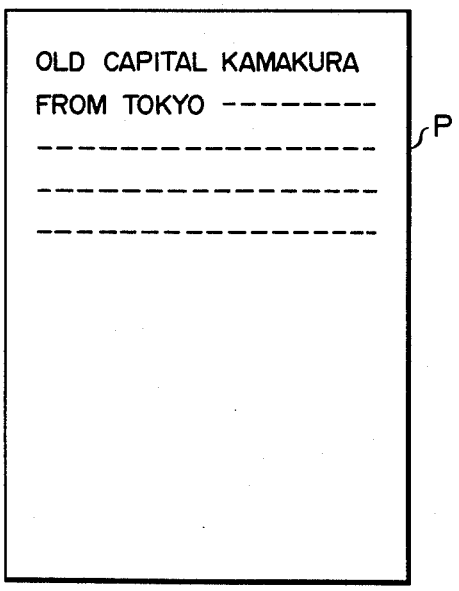
Figure 33:
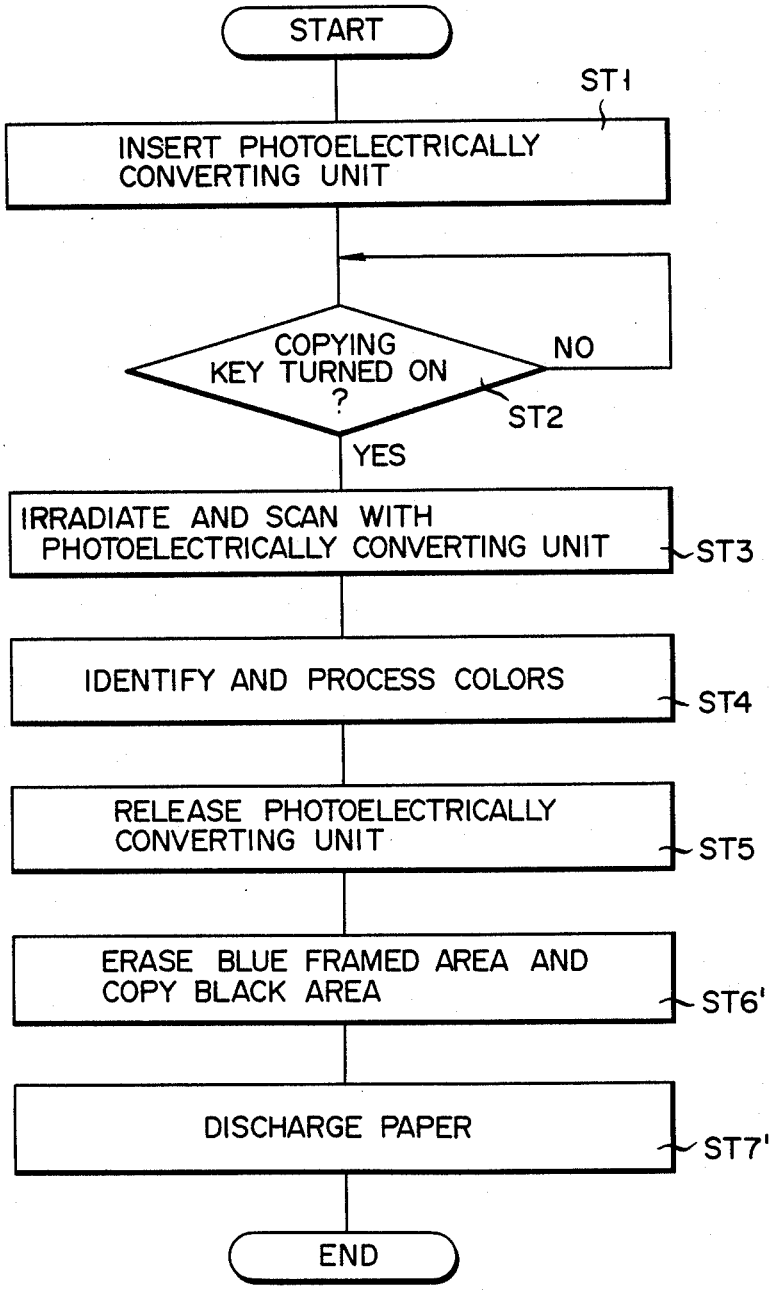

As shown in FIG. 32A, if black area Ga of original G is to be erased, area Ga is framed by blue ink Gb of the special pen, as indicated by a hatched area. In this state, area Ga is visually discernible because of blue ink Gb. Original G is placed on original table 2 and, when framed area erasure specifying key 30l and copying key $30_1$ are operated successively, the control operation shown in FIG. 33 is performed by main processor group 71. More specifically, in step ST1, CCD unit 171 is inserted between lens block 8 and mirror $9_1$.

Figure 27:
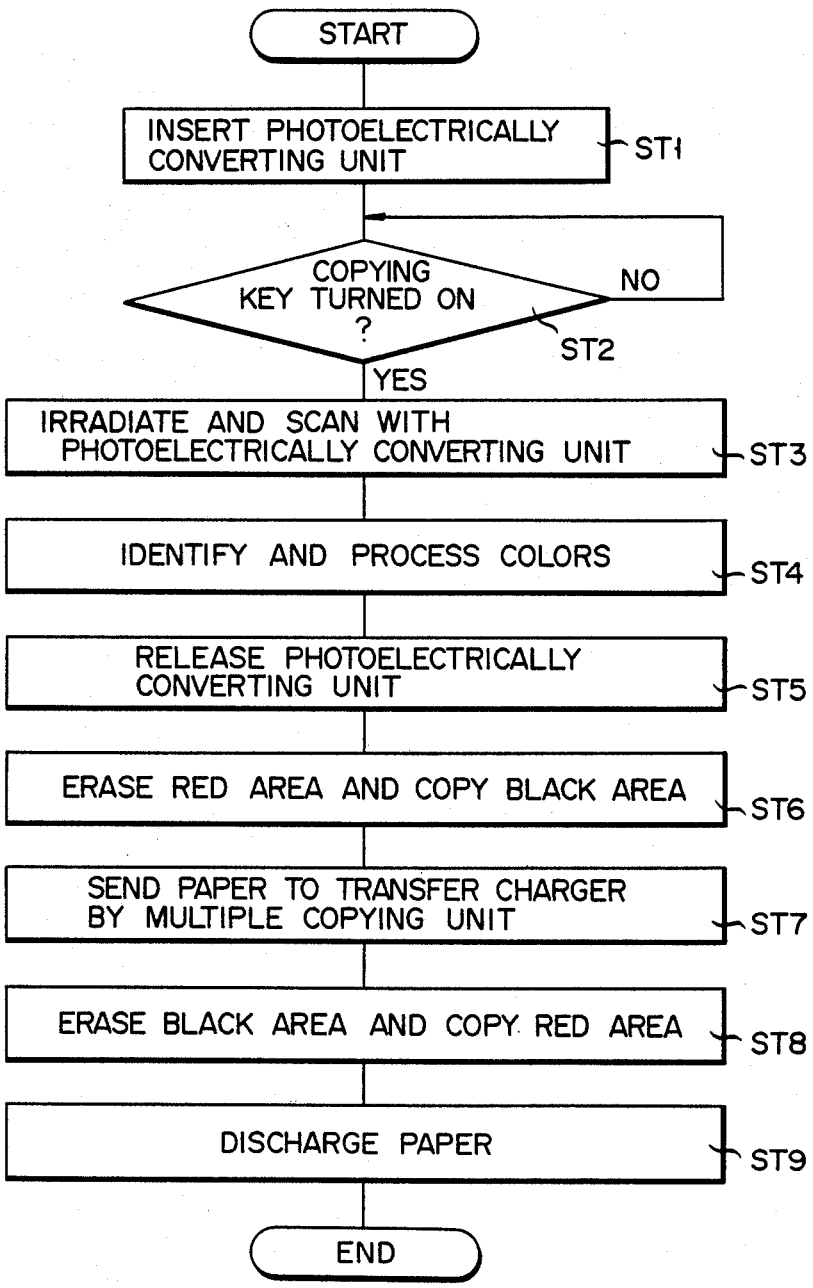

Thereafter, steps ST2 and ST3 described with reference to FIG. 27 are performed in substantially the same manner as described above. In step ST4, color identification processing of the image data stored in memory 194 is performed. Two data stored in memory 194 are added to each other or subtracted from each other to identify the black area and blue area Gb of the original image, and positional data thereof are stored in memory 194.

In step ST5, CCD unit 171 is removed from the optical path of lens block 8. In step ST6', an area framed by blue area Gb, i.e., an erasure area, is identified based on the positional data of blue area Gb stored in memory 194, and erasure data thereof is generated and stored in memory 140. More specifically, high level signals are stored in the addresses allocated for the area framed by blue area Gb, and low level signals are stored in the rest of the addresses. In this state, the copying operation of the black area of original G is carried out using developing unit $12_2$ containing black toner and erasure array 150. More specifically, first carriage $41_1$ is moved from position Ya in the direction indicated by arrow y1 in FIG. 28C, thus performing exposure scanning of the original.

In response to this, the erasure data is supplied to array driving unit 160 from memory 140, and erasure array 150 is operated in accordance with the erasure data to erase the electric charges on photosensitive drum 10 which correspond to blue area Gb. Therefore, after the developing and transferring operations, only the area other than that has been framed by blue ink Gb, shown in FIG. 32A, is copied on paper P. Thereafter, in step ST7', paper P is sent to discharging tray 25 through fixing roller pair 23 and exit roller pair $60_4$.

In this modification, when framed area erasure specifying key 30l is not operated, the ordinary copying operation described above is performed.

According to this modification, the erasure area of an original is framed by a blue ink and is identified by CCD unit 171, and the identification data is used to appropriately control array driving unit 160 and erasure array 150, thereby erasing the image within the specified area. Therefore, with a relatively simple arrangement, the desired area of an original image can be erased. For example, when the original image is to be edited, this arrangement is very effective.

In addition, an erasure area of the original can be easily specified, resulting in convenience.

What is claimed is:

1. An image forming apparatus with a plurality of colors, said apparatus comprising:

an original table for placing thereon an original which possesses at least a first color and a second color;

original scanning means for optically scanning an original placed on said original table, said means having an optical system to guide the image reflecting light coming from the original into a given light path;

first and second color component detection means for transmitting electric signals corresponding to said first and second colors in response to the image reflecting light, said means being movably provided on said light path along which said image reflecting light coming from said optical system of said original scanning means passes;

original color identifying means for identifying different color areas from the electric signals for said first and second colors transmitted from said first and second color component detection means and for storing the first and second color data and first and second positional data for the first and second colors in different color areas;

image forming means for forming an image of given colors of the original on an image forming medium by using said image reflecting light coming from said optical system of said original scanning means and by selectively driving first and second developing units which correspond to said first and second colors, respectively;

image erasing means for selectively erasing an image to be formed by said image forming means;

image forming medium return means for selectively returning said image forming medium to said image forming means after formation of an image by said image forming means;

first control means for producing a first control signal to drive said original scanning means and said first and second color component detection means prior to actual formation of an image;

second control means for reading out, at the time of the first image forming operation, said first color data that have been stored in said original color identifying means to send them to said first developing unit of said image forming means as drive signals and said second position data which correspond to said second color data to send them to said image erasing means as erasure data and for producing a second control signal to said image forming medium return means as an instruction for a return operation; and third control means for reading out, at the time of the second image forming operation, said second color data that have been stored in said original color identifying means to send them to said second developing unit of said image forming means and said first positional data which correspond to said first color data to send them to said image erasing means as erasure data.

2. An apparatus according to claim 1, wherein said first and second color component detection means include first and second CCD line sensors which are arranged adjacent to each other and can produce signals corresponding to the identical portion of the original to have a delay time therebetween when said sensors transmit the electric signals for the first and second colors in response to the image reflecting light, and two color filters opposite said first and second CCD line sensors, and said original color identifying means includes means which processes the signals corresponding to the identical portion of the original to have the delay time therebetween and produced from said first and second color component detection means taking the delay time into consideration, thereby scanning the identifical portion of the original to identify the colors thereof.

3. An apparatus according to claim 2, wherein the delay time is given to correspond with the number of drive pulses of a stepping motor for driving said original scanning means.

4. An apparatus according to claim 2, wherein light receiving sections of said first and second CCD line sensors are deviated to decrease a distance therebetween.

* * * * *